US010755518B2

(12) United States Patent
Wright

(10) Patent No.: US 10,755,518 B2
(45) Date of Patent: Aug. 25, 2020

(54) GAMING SYSTEM PROVIDING A REEL-BASED WAGERING GAME WITH MODIFIERS

(71) Applicant: IGT, Las Vegas, NV (US)

(72) Inventor: David Wright, Lichfield (GB)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 16/135,463

(22) Filed: Sep. 19, 2018

(65) Prior Publication Data

US 2020/0090457 A1 Mar. 19, 2020

(51) Int. Cl.
*G07F 17/32* (2006.01)
*G07F 17/34* (2006.01)

(52) U.S. Cl.
CPC ..... *G07F 17/3213* (2013.01); *G07F 17/3209* (2013.01); *G07F 17/3244* (2013.01); *G07F 17/34* (2013.01)

(58) Field of Classification Search
CPC ..... G07F 17/3213; G07F 17/3209; G07F 17/3244; G07F 17/34
See application file for complete search history.

(56) References Cited

U.S. PATENT DOCUMENTS 8,425,303 B2 4/2013 Kennedy et al.
8,764,537 B2 7/2014 Jaffe et al.
9,202,339 B2 12/2015 Ching et al.
9,824,523 B2 11/2017 Cannon et al.
10,269,217 B2 4/2019 Nakamura
10,275,991 B2 4/2019 Craig
2003/0064805 A1* 4/2003 Wells ..... G07F 17/32 463/39
2004/0082384 A1* 4/2004 Walker ..... G07F 17/32 463/40
2005/0261063 A1* 11/2005 Boyd ..... G07F 17/32 463/42
2008/0108411 A1 5/2008 Jensen et al.
2017/0004674 A1 1/2017 Caputo et al.
2017/0092073 A1* 3/2017 Nakamura ..... G07F 17/3267

* cited by examiner

*Primary Examiner* — Werner G Garner

(74) *Attorney, Agent, or Firm* — Neal, Gerber & Eisenberg LLP

(57) ABSTRACT

Embodiments of a gaming system employ a processor and a memory device, wherein the memory device stores instructions that, when executed by the processor, cause the processor to cause a display device to display a top matrix expression and a first base matrix outcome for a reel-based wagering game. Responsive to the occurrence of a modifier event in various embodiments, the instructions cause the processor to alter the top matrix expression. Responsive to the occurrence of a modifier event in various other embodiments, the instructions cause the processor to replace the first base matrix outcome with a second base matrix outcome that incorporates the top matrix expression.

20 Claims, 16 Drawing Sheets

GAMING SYSTEM PROVIDING A REEL-BASED WAGERING GAME WITH MODIFIERS

BACKGROUND

The present disclosure relates generally to gaming systems, and more particularly to gaming systems providing a reel-based wagering game.

Electronic gaming machines (EGMs) enable play of various types of wagering games, including reel-based wagering games. An EGM typically initiates a play of a wagering game once a wager input and a game initiation input are received. In a reel-based wagering game, upon receipt of a game initiation input such as an actuation of a play or spin button, for example, an array of symbols on various reels is generated and displayed. Awards are granted to a player based upon an occurrence of certain symbol combinations across pay lines. Typically, a reel-based wagering game ends after a single spin of the reels is made and any award is granted.

BRIEF SUMMARY

Embodiments of the gaming system and method of the present disclosure employ a processor and a memory device, wherein the memory device stores instructions that, when executed by the processor, cause the processor to cause a display device to display a top matrix expression and a first base matrix outcome for a reel-based wagering game. In various embodiments, the top matrix expression displays one or more reels containing a symbol from a group of available symbols, and the first base matrix outcome displays multiple reels with a set of symbols that may reflect a modifier event. Responsive to the occurrence of a modifier event in various embodiments, the instructions cause the processor to alter the top matrix expression. Responsive to the occurrence of a modifier event in various other embodiments, the instructions cause the processor to replace the first base matrix outcome with a second base matrix outcome that incorporates the top matrix expression.

In various embodiments, the gaming system determines and displays any awards associated with the first base matrix outcome, as well as any awards associated with the second base matrix outcome caused by the occurrence of one or more modifier events.

DETAILED DESCRIPTION

Figure 1:
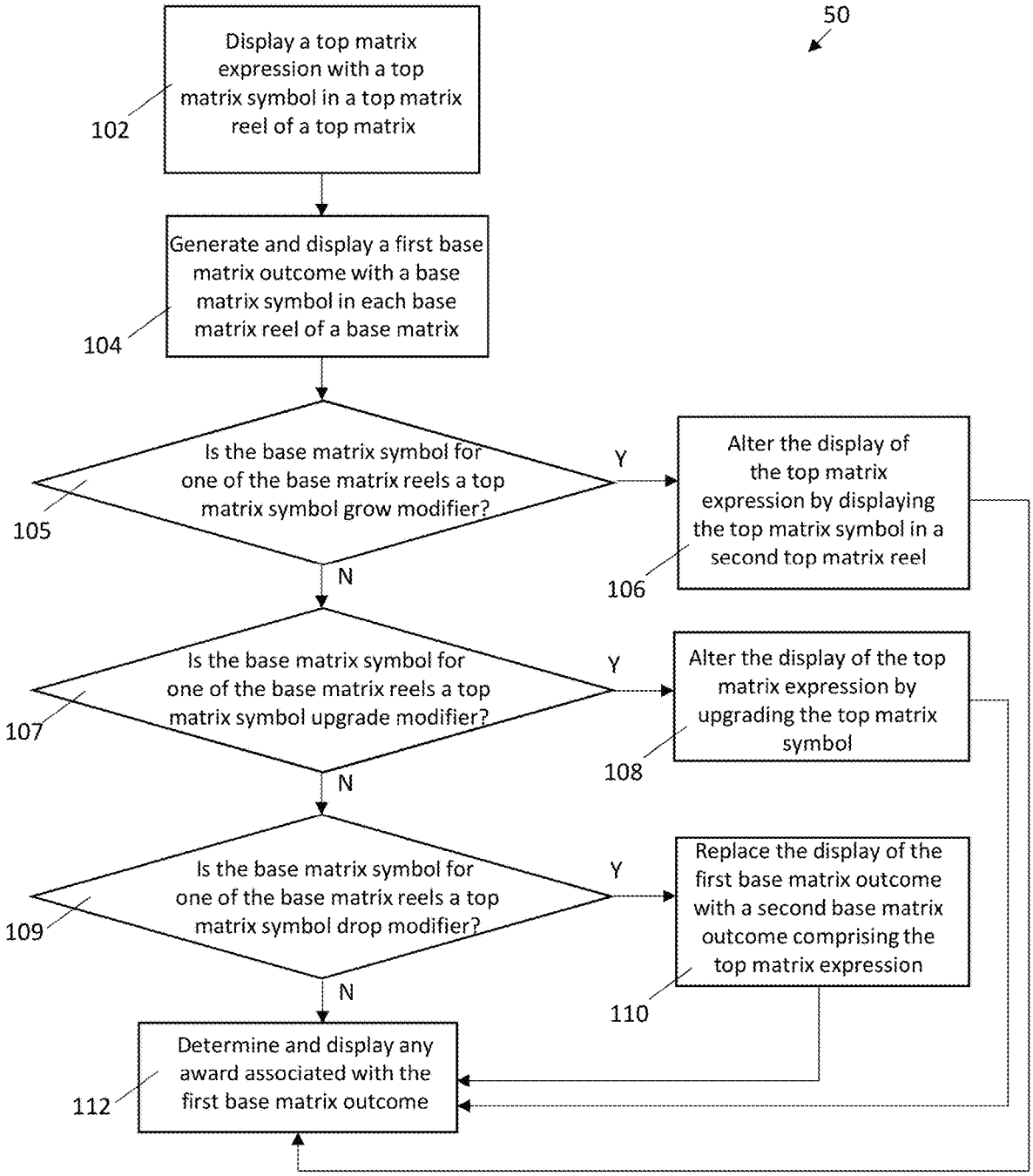
FIG. 1 is a flow chart illustrating an example process for operating a gaming system employing a top matrix and a base matrix as disclosed herein.

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

Example embodiments such as disclosed herein can incorporate a controller having a processor and an associated memory storing instructions that, when executed by the processor, cause the processor to perform operations as described herein. It will be appreciated that reference to "a", "an" or other indefinite article in the present disclosure encompasses one or more than one of the described element. Thus, for example, reference to a processor encompasses one or more processors, reference to a memory encompasses one or more memories, reference to a reel encompasses one or more reels and so forth.

In various embodiments, the gaming system disclosed herein employs a tumbling reel game with one or more reels in either an electromechanical form with mechanical rotating reels or in a video form with simulated reels and movement thereof. Each reel displays one or more symbols from a set of symbols, such as bells, hearts, fruits, numbers, letters, bars, or other images that typically correspond to a theme associated with the gaming system. The set of symbols can range in value from a lowest value to a highest value. For instance, the cherries symbol may rank as the lowest value and the diamond symbol may rank as the highest value. In certain embodiments, one or more of the reels are unisymbol reels, which display a single symbol throughout the reel.

In certain embodiments, the gaming system includes one or more paylines associated with the reels. For example, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). Embodiments of the gaming system disclosed herein enable a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

Referring now to FIG. 1, a flowchart of an example embodiment of a process 50 for operating a gaming system disclosed herein is illustrated. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be employed. For example, the order of certain steps described may be changed, or certain steps described may be optional.

Figure 2:
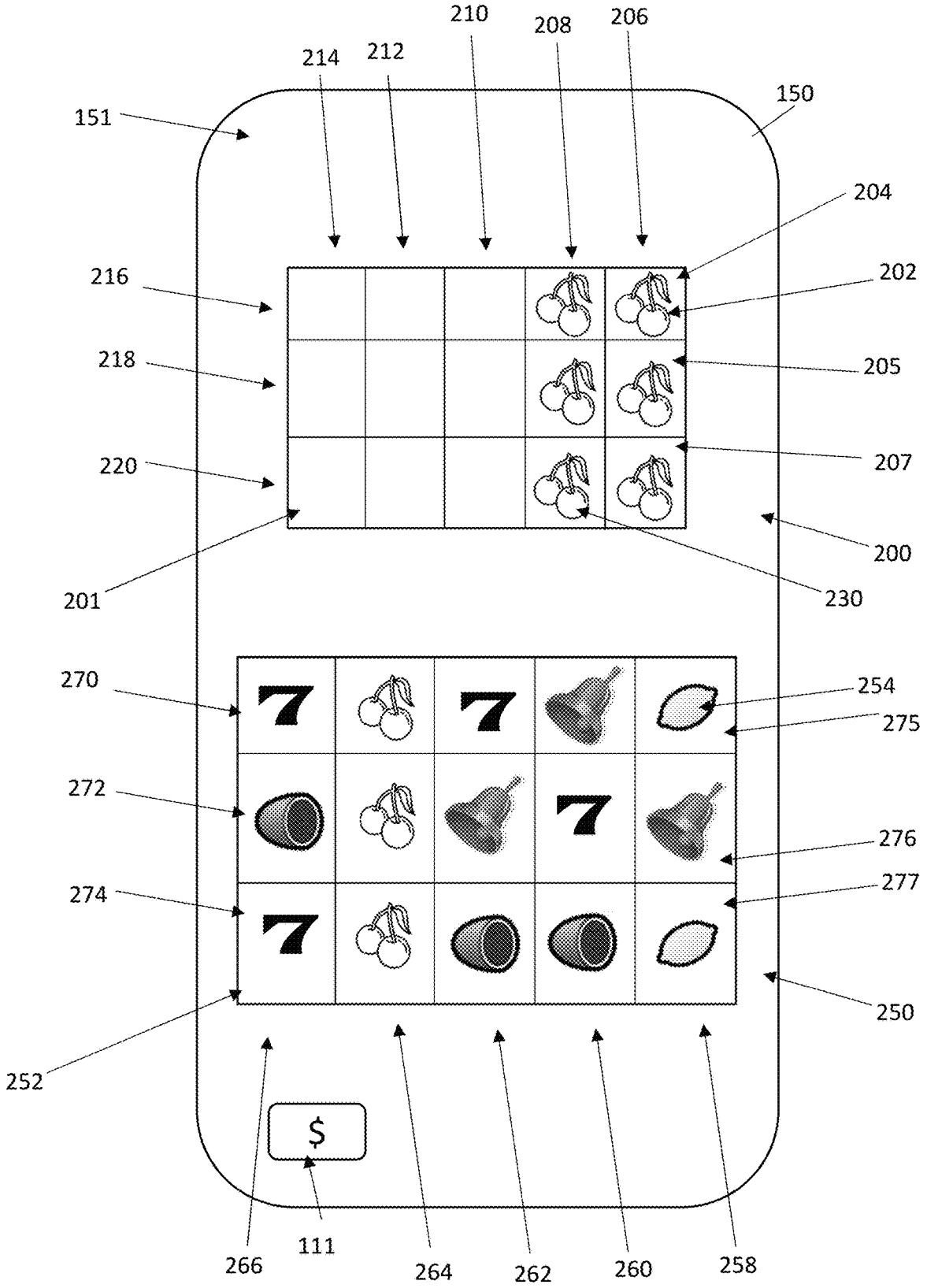
FIGS. 2 through 13 are views of exemplary displays in accordance with embodiments of the gaming system of the present disclosure.

As indicated at block 102, the process 50 displays a top matrix expression with a top matrix symbol in a top matrix reel of a top matrix. An exemplary top matrix expression 201 is shown on a personal gaming device 150 in FIG. 2 with a top matrix symbol 202 in a top matrix reel 206 of top matrix 200. As shown in FIG. 2, the top matrix 200 can be represented as a matrix of five reels 206, 208, 210, 212 and 214 and three rows 216, 218, 220, such that each reel (e.g., 206) has three spaces (e.g., 204, 205, 207), although it will be appreciated that other dimensions can be employed. It will be appreciated that the top matrix symbol 202 can be displayed in multiple spaces 204, 205, 207 in the top matrix reel 206, and that additional top matrix symbols (e.g., 230) can be displayed in other top matrix reels (e.g., 208). In various embodiments, each reel in the top matrix 200 is a unisymbol reel when populated, although all reels 206, 208, 210, 212 and 214 in the top matrix 200 may not be populated with symbols at all times. For instance, as shown in FIG. 2, reels 206 and 208 are populated whereas reels 210, 212 and 214 are not populated with any symbols.

As indicated at block 104 in FIG. 1, the process 50 generates and displays a first base matrix outcome with a base matrix symbol in each base matrix reel of a base matrix. As shown in FIG. 2, the base matrix 250 can be represented as a matrix of five reels 258, 260, 262, 264 and 266 and three rows 270, 272, 274, such that each reel (e.g., 258) has three spaces (e.g., 275, 276, 277), although it will be appreciated that other dimensions can be employed. Each play or spin of the game can be reflected in the display 151 by tumbling reels of the base matrix 250, for example. It will be appreciated that, in various embodiments such as shown in FIG. 2, for example, the first base matrix outcome (e.g., 252) includes a symbol (e.g., 254) in each space (e.g., 275, 276, 277) for each base matrix reel 258, 260, 262, 264, 266. It will further be appreciated that, in various embodiments, the top matrix expression 201 is not modified directly by a player spin; however, the top matrix expression 201 can be modified if a modifier event occurs as described elsewhere herein. Further, the top matrix 200 with top matrix expression 201 can be displayed anywhere in relation to the base matrix 250, and may or may not be positioned above the base matrix 250.

Figure 3:
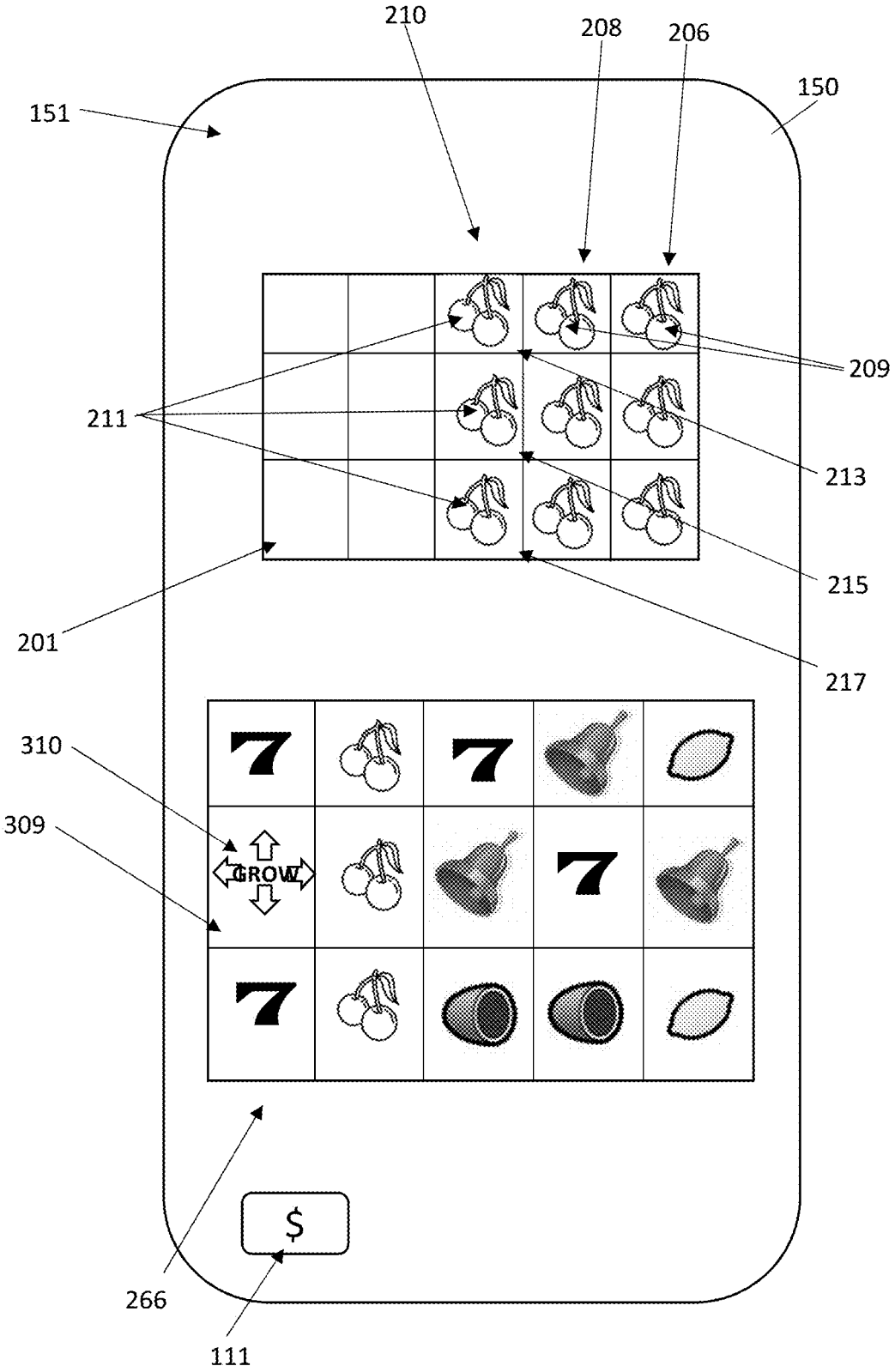
Figure 4:
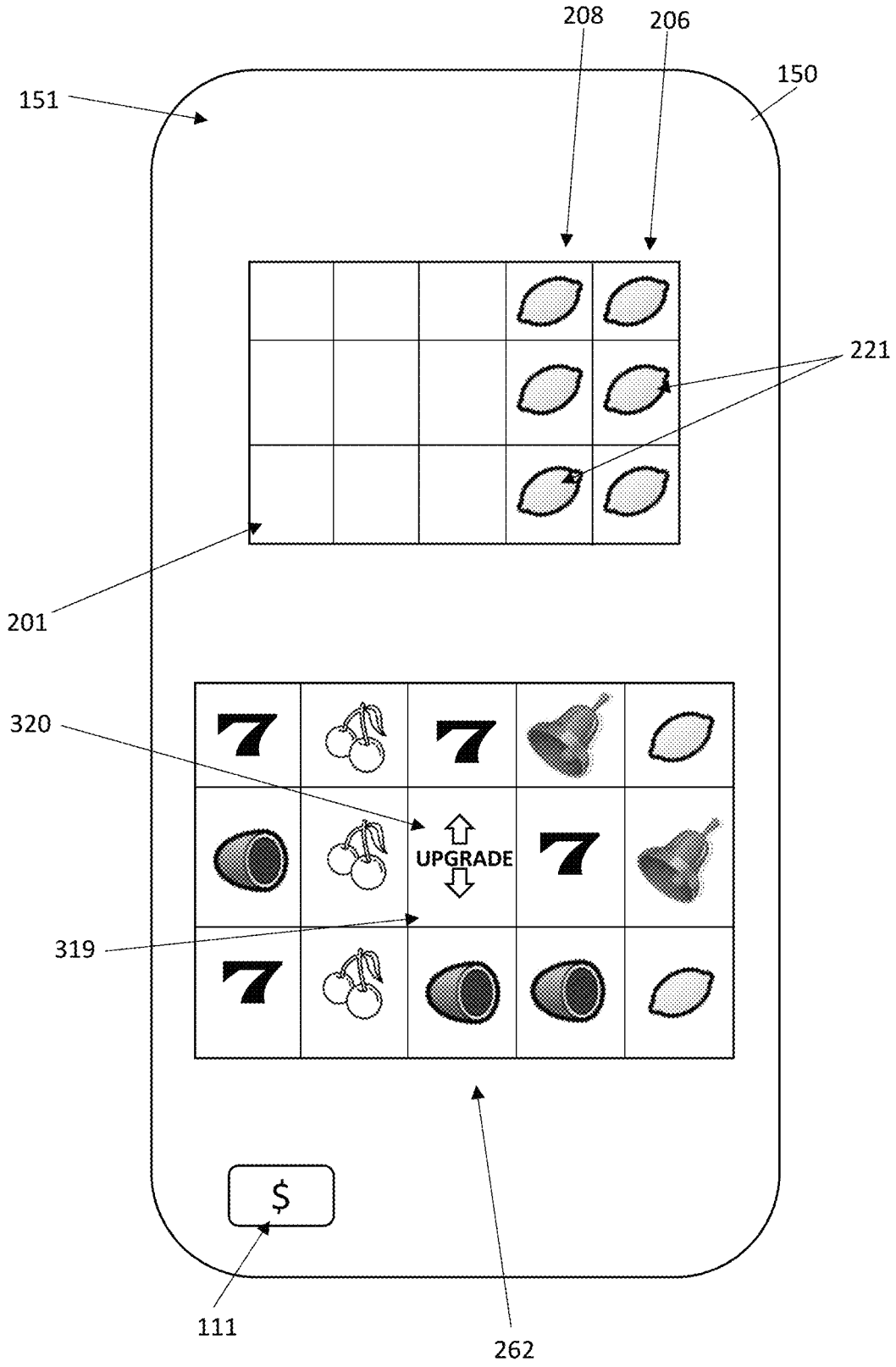
Figure 5:
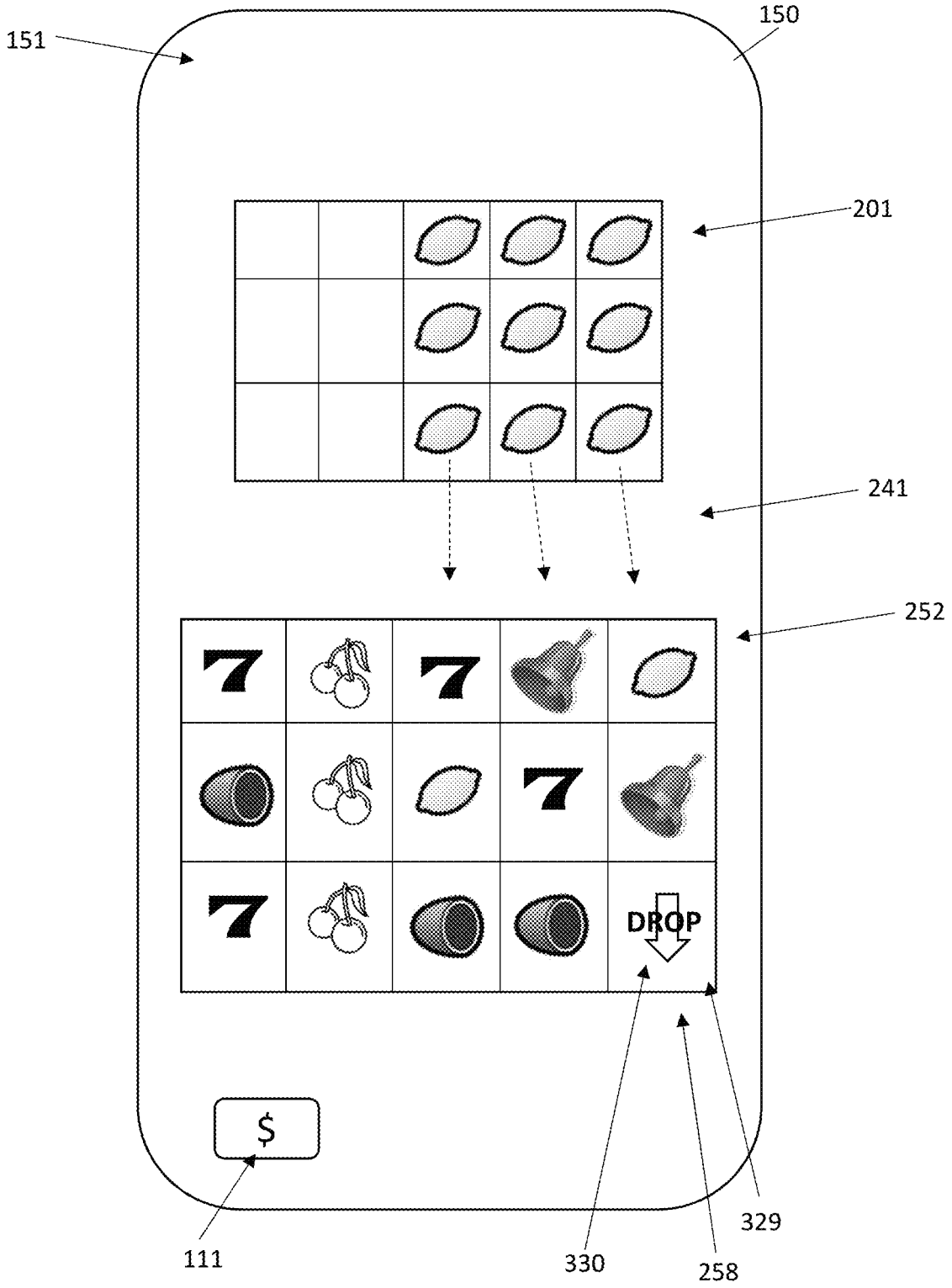

As at blocks 105, 107 and 109 in FIG. 1, the gaming system determines whether a modifier event has occurred. A modifier event can occur in a variety of ways. In various embodiments, a modifier event occurs when a base matrix symbol appears as a modifier symbol after a spin. In the event a base matrix symbol appears as a top matrix symbol grow modifier, as at block 105, the method alters the display of the top matrix expression, as at block 106, by displaying the top matrix symbol in a second top matrix reel. For example, FIG. 3 illustrates a top matrix symbol grow modifier 310 in space 309 of base matrix 250. Referring back to FIG. 1, in the event a base matrix symbol appears as a top matrix symbol upgrade modifier, as at block 107, the method alters the display of the top matrix expression, as at block 108, by upgrading the top matrix symbol. For example, FIG. 4 illustrates a top matrix symbol upgrade modifier 320 in space 319 of base matrix 250. Referring back to FIG. 1, in the event a base matrix symbol appears as a top matrix drop modifier, as at block 109, the method replaces the display of the first base matrix outcome with a second base matrix outcome comprising the top matrix expression, as at block 110. For example, FIG. 5 illustrates a top matrix symbol drop modifier 330 in space 329 of base matrix 250.

If no modifier event occurs, such as shown in the exemplary first base matrix outcome 252 of FIG. 2, or after a modifier event occurs, then, as at block 112 in FIG. 1, the method determines whether an award has been won according to the pay lines associated with the underlying game, and displays the award. In various embodiments, if the first base matrix outcome (e.g., 252 in FIG. 5) is replaced with a second base matrix outcome (e.g., 290 in FIG. 6), the method further determines and displays any award associated with the second base matrix outcome, as will be exemplified elsewhere herein. Thus, in any given spin, the player may win a first award based on the first base matrix outcome and a second award based on a second base matrix outcome. In this way, the gaming experience is improved for players as they are given multiple chances to win with multiple base matrix outcomes in a single spin. Embodiments of the gaming system as described herein thus provide improvements in computer-implemented gaming technology through the use of modifier events, which avoid the situation where a single spin results in a single outcome for a single matrix and which can be unsatisfying to a player. Further, embodiments of the gaming system as described herein overcome technical challenges of incorporating an additional matrix (e.g., the top matrix 200) in the available display space of a gaming device display while having the additional matrix influence potential player awards in the base matrix outcome. Per various embodiments of the present disclosure, the additional top matrix display combined with the opportunity for additional awards based on the base matrix display as it incorporates the top matrix expression further improve the gaming experience for the player, lead to prolonged player engagement and entice new players to engage with the gaming system. Additionally, embodiments the gaming system disclosed herein generate increased revenue to the gaming system operator by increasing play of the gaming system.

In various embodiments, once any awards have been determined for a given spin, the player can be prompted with an offer to continue play, in which case the player can initiate a new spin. If the player elects to continue play, in various embodiments and regardless of whether a modifier event had occurred in the previous spin, the top matrix expression 201 will be maintained as it existed at the end of the previous spin and will not be re-set to an initial state. Accordingly, as a player builds symbols in the top matrix expression 201 that may ultimately drop to the base matrix 250 as part of a second base matrix outcome (e.g., 290 in FIG. 6), the player is incentivized to continue playing for the opportunity to win more and/or greater awards. This further improves the gaming experience and leads to prolonged player engagement.

FIGS. 3 through 13 illustrate additional screen displays 151 of example embodiments of a gaming system operating the example reel-based wagering game with modifiers. As shown in FIG. 3, the modifier event is exemplified as a top matrix symbol grow modifier 310 within space 309 of base matrix reel 266. It will be appreciated that the modifier event can be exemplified in other ways, such as, for example, a display that is not part of the base matrix outcome 252 but may be part of another portion of a display (e.g., 151) of a personal gaming device (e.g., 150).

As further shown in FIG. 3, responsive to the top matrix symbol grow modifier 310 appearing as a result of a player spin, the top matrix expression 201 is altered by adding symbols 211 to the reel 210 next to the existing reel(s) 206, 208 with displayed symbols. In various embodiments, the added symbols 211 in reel 210 are the same symbols 209 that are displayed in the existing reel(s) 206, 208 with displayed symbols. Thus, for example, if the right-most reels 206 and 208 display cherries 209 and the modifier event is a top matrix symbol grow modifier, the next reel 210 in sequence from reels 206 and 208 can be altered to display cherries 209 in each space 213, 215, 217 of the reel 210. It will be appreciated that a single top matrix symbol or multiple top matrix symbols can be added to a reel as a result of a grow modifier. In various embodiments, the top matrix expression 201 has an initial setting with two reels (e.g., 206, 208) containing the same symbol (e.g., cherries 209) in each space within the reels 206, 208. In such embodiments, the reels 206, 208, 210, 212, 214 of the top matrix 200 are considered unisymbol reels, as they contain the same symbol throughout the reel, when populated. Incorporating unisymbol reels can assist in incentivizing players to continue playing, as the potential for multiple instances of the same symbol to drop to become part of the modified base matrix outcome (e.g., 290 in FIG. 6) may increase the award chances and/or award amount to the player.

As shown in FIG. 4, the modifier event is represented as a top matrix symbol upgrade modifier 320 within space 319 of base matrix reel 262. Responsive to the top matrix symbol upgrade modifier 320 appearing as a result of a player spin, the top matrix expression 201 is altered by replacing the top matrix symbol(s) with an upgraded symbol. It will be appreciated that the upgraded symbol has a value that is higher than the existing value of the top matrix symbol. Thus, for example, if the cherries are the lowest value symbol, and the lemons have the next highest value, then the cherries in reels 206, 208 in FIG. 1 can be replaced by lemons 221, as shown in FIG. 4. It will be appreciated that a single top matrix symbol or multiple top matrix symbols can be upgraded as a result of an upgrade modifier.

Figure 6:
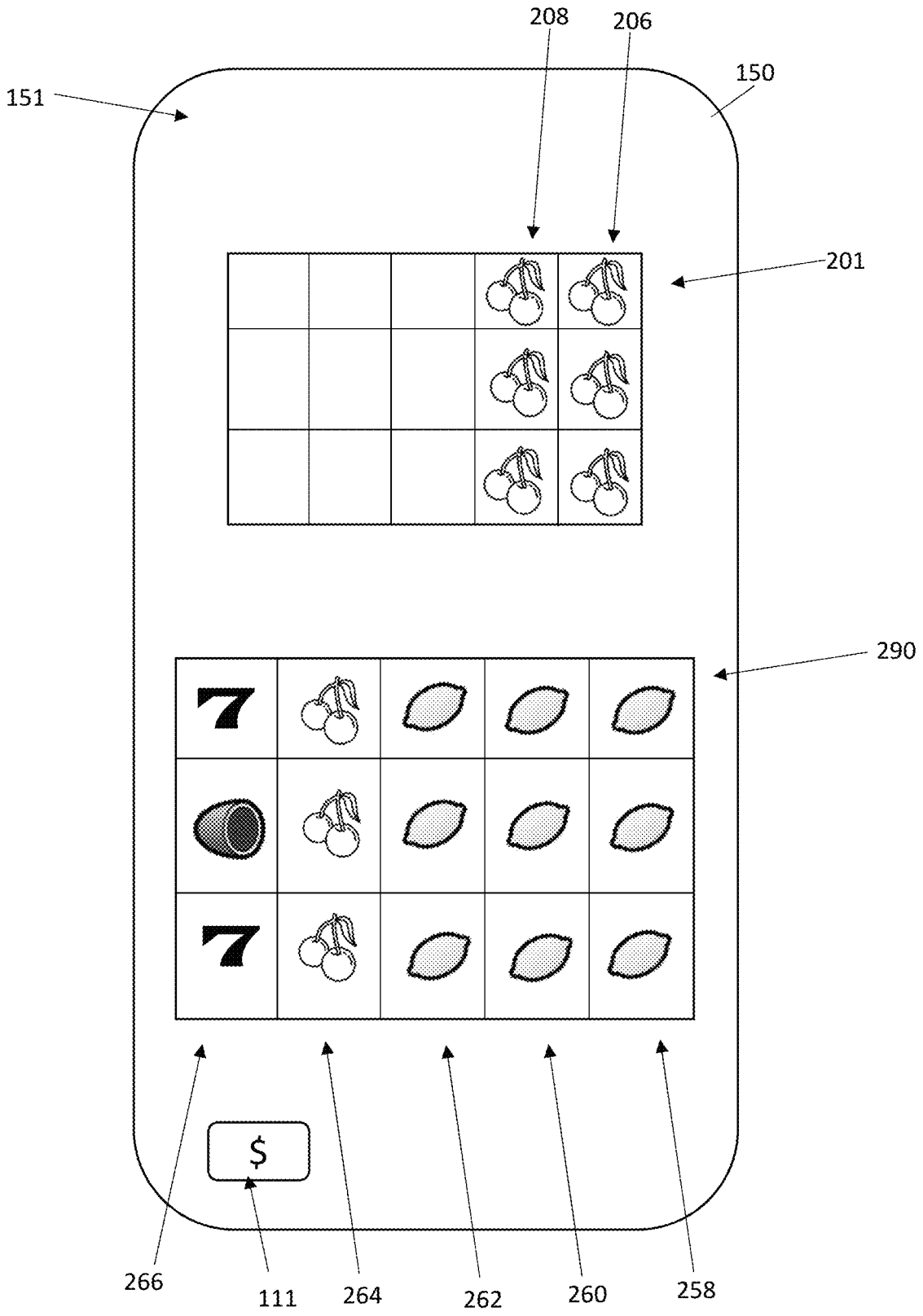
Figure 7:
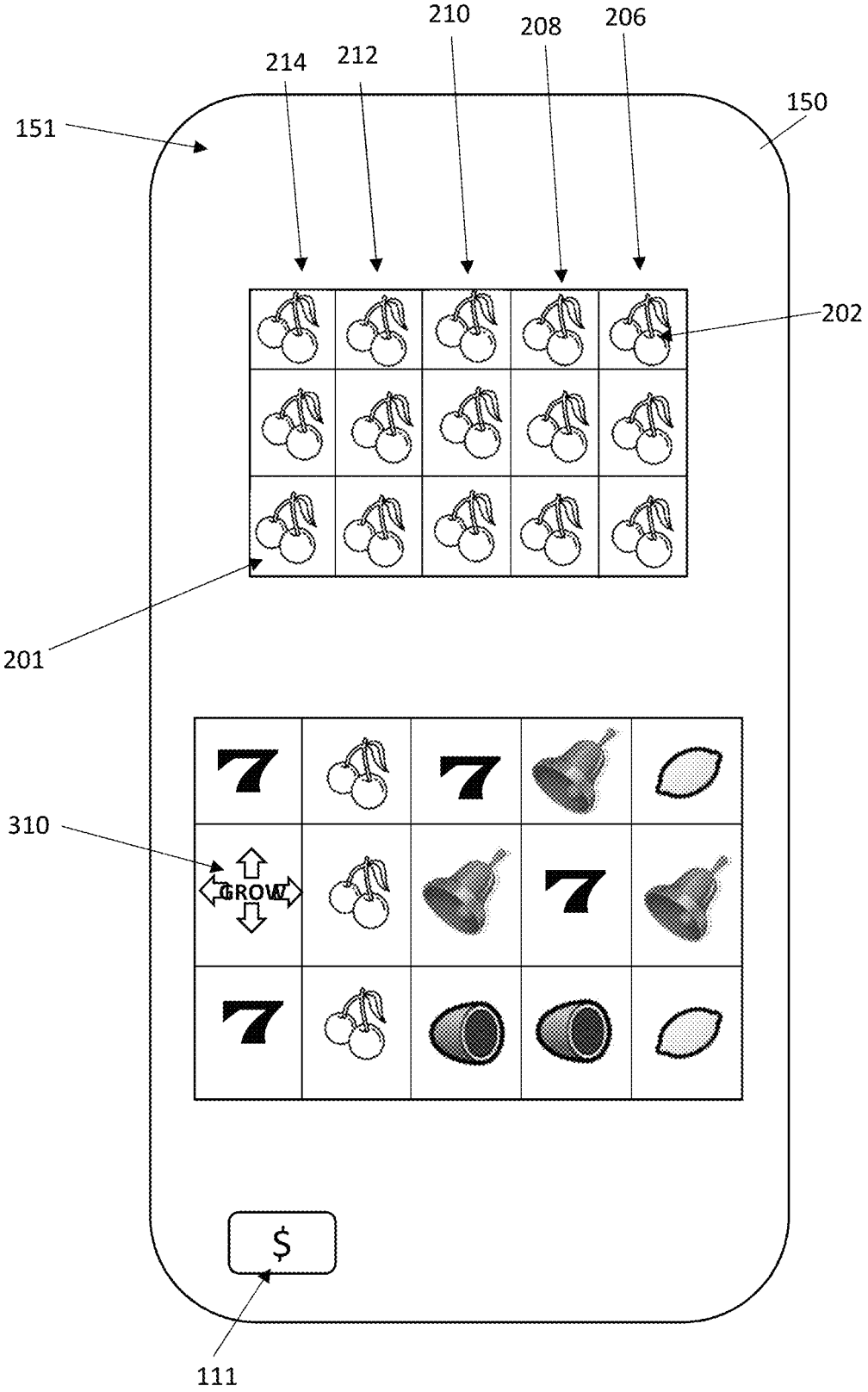
Figure 8:
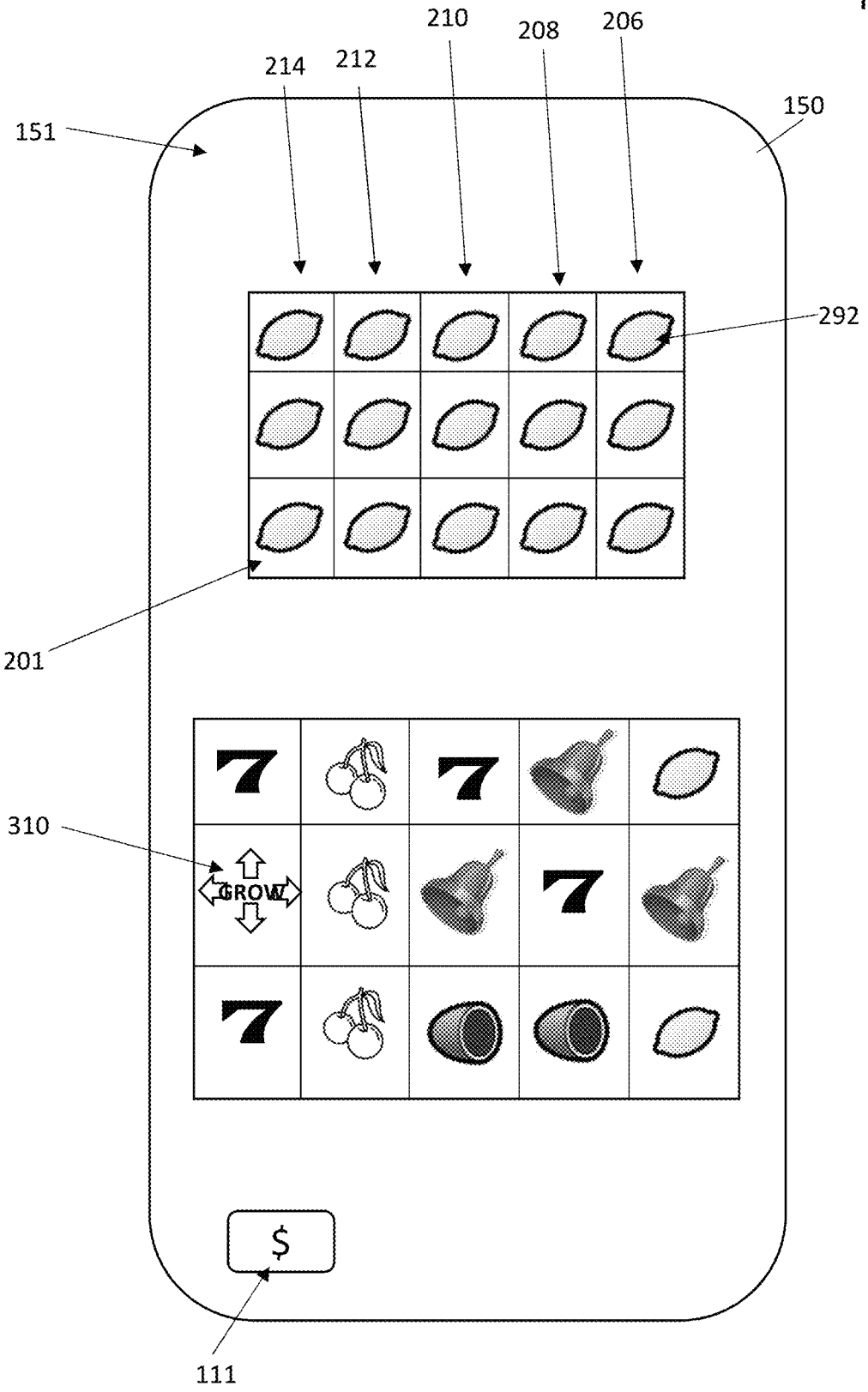

As shown in FIGS. 5 and 6, the modifier event is represented as a top matrix symbol drop modifier 330 within space 329 of base matrix reel 258. Responsive to the top matrix symbol drop modifier 320 appearing as a result of a player spin, the top matrix expression 201 is altered by dropping (as indicated at 241) the existing top matrix expression 201 into the base matrix outcome 252, which results in the first base matrix outcome being replaced with a display of a second base matrix outcome 290 containing the top matrix expression 201, as shown in FIG. 6. The second base matrix outcome 290 is shown in FIG. 6 with three reels 258, 260, 262 of lemon symbols that had been in the top matrix expression 201 of FIG. 5. The second base matrix outcome 290 is further shown with reels 264, 266 that have not been altered from the first base matrix outcome 252 of FIG. 5. Thus, the gaming system can operate such that the number of reels populated with symbols from the top matrix expression 201 replace the equivalent number of reels in the first base matrix outcome (e.g., 252 in FIG. 5), leaving the remaining reels in the first base matrix outcome intact. In this way, embodiments of the gaming system provide an improved gaming experience by combining the top matrix expression 201 with elements of the first base matrix outcome (e.g., 252), which may or may not result in additional awards, but gives the player the experience and excitement of anticipating potential additional awards by the second base matrix outcome (e.g., 290 in FIG. 6). Any award associated with the second base matrix outcome 290 is determined and can be displayed as at 111 on display 151 of device 150. In various embodiments, a subset of the top matrix expression 201 can be dropped to replace a portion of the base matrix outcome, rather than the full top matrix expression 201. As further shown in FIG. 6, the display of the top matrix expression 201 can also be changed, for example, back to an initial setting, as a result of the top matrix symbol drop modifier appearing. For example, in the display 151 of FIG. 6, reels 206, 208 of the top matrix expression 201 are initialized as cherry symbols.

It will be appreciated that a single spin can result in two or more modifier events. For example, a first modifier event may be a top matrix symbol grow modifier and a second modifier event may be a top matrix symbol upgrade modifier. In such case, the modifier events can be executed in order of their appearance or in another manner. For example, responsive to a top matrix symbol grow modifier and a top matrix symbol upgrade modifier appearing in the same spin, the top matrix expression may be altered by displaying the top matrix symbol in an additional top matrix reel, and then further altered by replacing the top matrix symbol with an upgraded symbol for all reels containing symbols.

In another embodiment with two modifier events, where a first modifier event is a top matrix symbol grow modifier and a second modifier event is a top matrix symbol drop modifier, the top matrix expression can first be altered by displaying the top matrix symbol in an additional top matrix reel. Subsequently, the display of the first base matrix outcome can be replaced with a display of a second base matrix outcome, wherein the second base matrix outcome appears with the symbols from the top matrix expression. In such embodiments, the top matrix expression 201 can also be changed back to an initial setting such as shown in FIG. 6.

In another embodiment with two modifier events, where a first modifier event is a top matrix symbol upgrade modifier and a second modifier event is a top matrix symbol drop modifier, the top matrix expression can be altered by replacing the top matrix symbol with an upgraded symbol for all reels containing symbols, and then subsequently the display of the first base matrix outcome can be replaced with a display of a second base matrix outcome, wherein the second base matrix outcome appears with the symbols from the top matrix expression. In such embodiments, the top matrix expression 201 can also be changed back to an initial setting such as shown in FIG. 6.

In other embodiments, a single spin can result in three modifier events, where a first modifier event is a top matrix symbol grow modifier, a second modifier event is a top matrix symbol upgrade modifier and a third modifier event is a top matrix symbol drop modifier. In such case, the top matrix expression can be altered by displaying the top matrix symbol in an additional top matrix reel and replacing the top matrix symbol with an upgraded symbol for all reels containing symbols. Subsequently, the display of the first base matrix outcome can be replaced with a display of a second base matrix outcome, wherein the second base matrix outcome appears with the symbols from the top matrix expression. In such embodiments, the top matrix expression 201 can also be changed back to an initial setting such as shown in FIG. 6. It will be appreciated that the potential for multiple modifier events to occur in a single spin further enhances the player experience, generating excitement and anticipation regarding potential additional awards.

In certain instances, it may not be possible to activate a modifier event under ordinary operation. For example, as shown in the display 151 of FIG. 7, all of the reels 206, 208, 210, 212, 214 of the top matrix expression 201 are filled with symbols (e.g., 202) such that a top matrix symbol grow modifier 310 cannot ordinarily be executed. In such instances, the modifier event may not be executed and the top matrix expression 201 would stay the same. Nevertheless, in various embodiments, the system can effectuate the modifier event in different ways beyond how the modifier event would ordinarily be executed. For example, in the instance of FIG. 7 where the modifier event is a top matrix symbol grow modifier 310 and the top matrix expression 201 already includes symbols (e.g., 202) in each of the top matrix reels 206, 208, 210, 212, 214, the system can operate to upgrade the symbols (e.g., from 202 in FIG. 7 to 292 in FIG. 8) in the top matrix expression 201.

Figure 9:
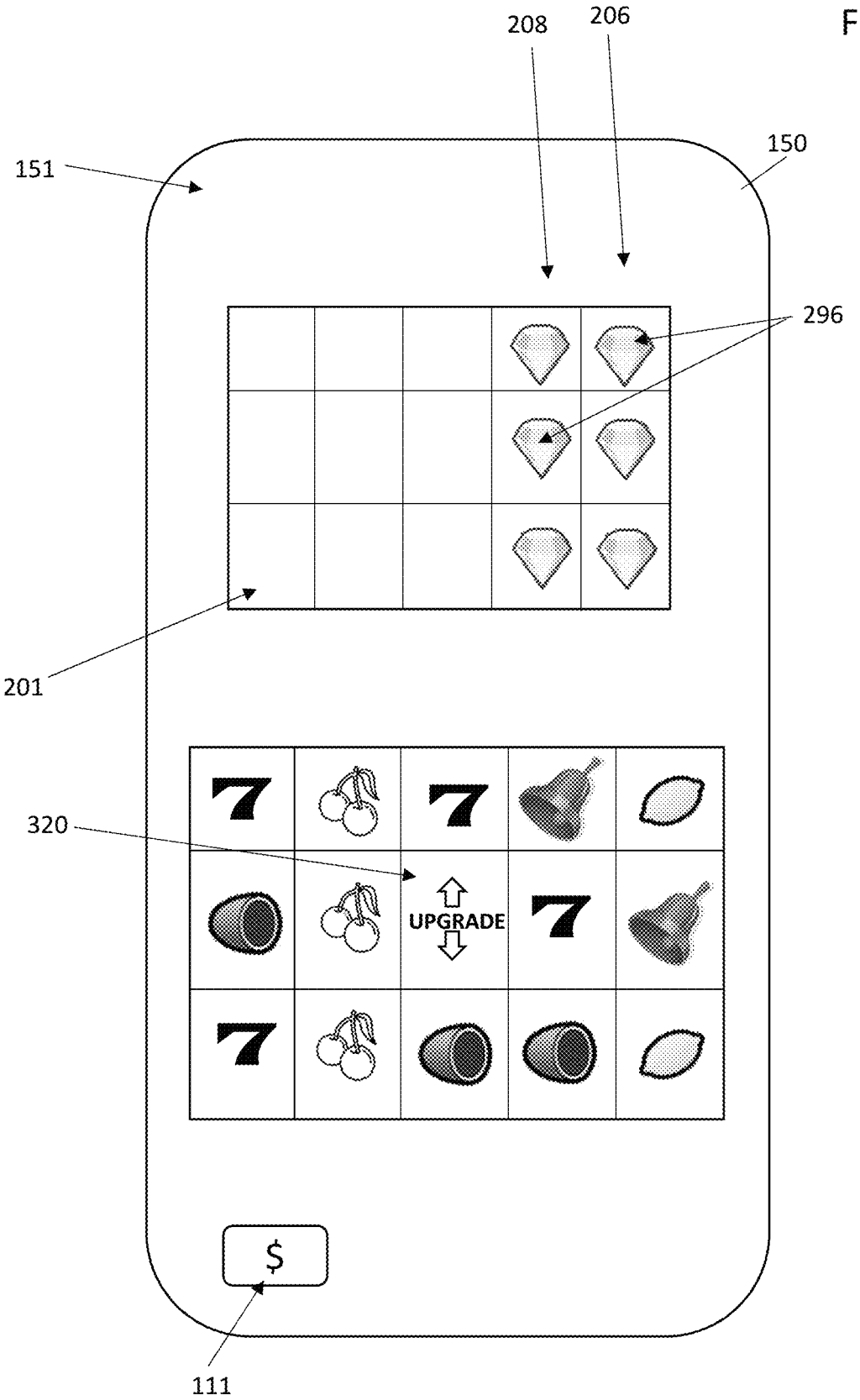
Figure 10:
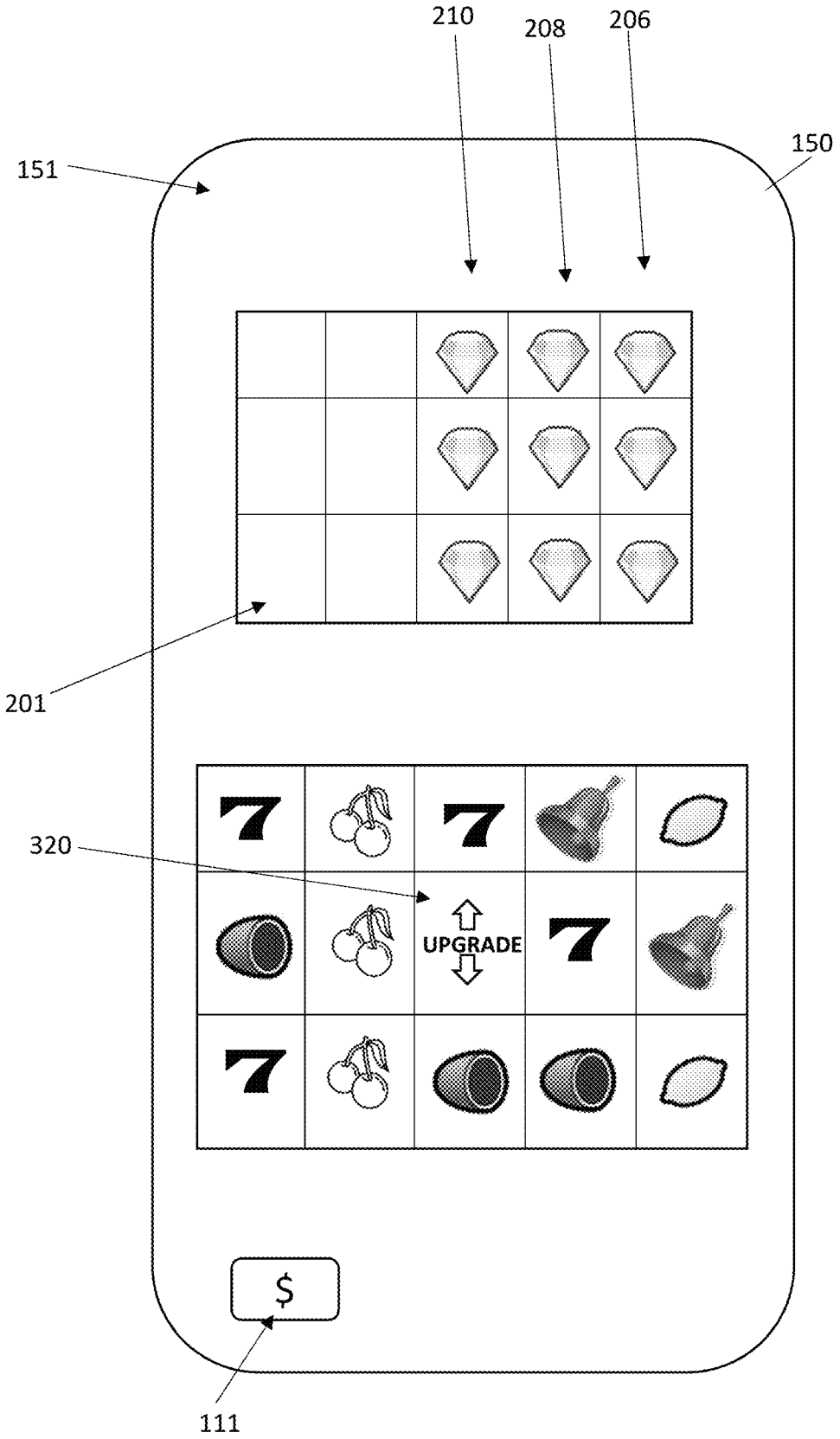

As another example, with reference to FIG. 9, all of the symbols (e.g., 296) in the top matrix expression 201 are at the highest value (e.g., a diamond) such that a top matrix symbol upgrade modifier 320 cannot ordinarily be executed. In such instances, the modifier event may not be executed and the top matrix expression 201 would stay the same. Alternatively, the system can effectuate the modifier event in different ways beyond how the modifier event would ordinarily be executed. For example, as shown in FIG. 10, given the circumstances above with regard to FIG. 9, the gaming system can operate to display the symbol(s) 296 in reels 206 and 208 in an additional top matrix reel 210. In other words, the system can treat the top matrix symbol grow modifier 310 as a top matrix symbol upgrade modifier if there are no reels left to fill in the top matrix (FIGS. 7 and 8), and can further treat the top matrix symbol upgrade modifier 320 as a top matrix symbol grow modifier if the symbols in the top matrix expression are of the highest value (FIGS. 9 and 10).

Figure 11:
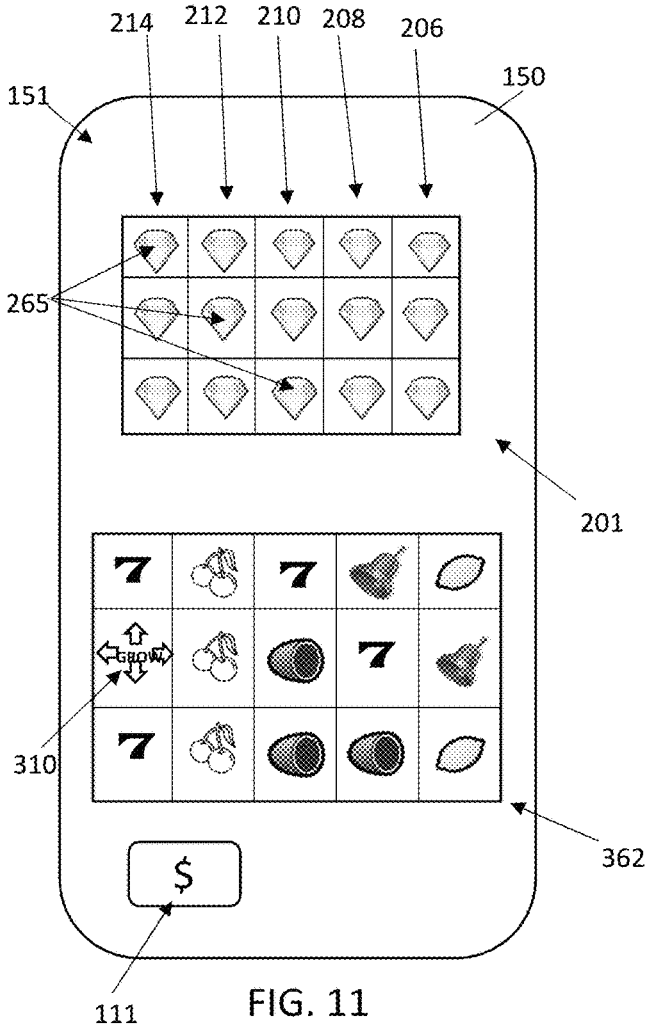
Figure 12:
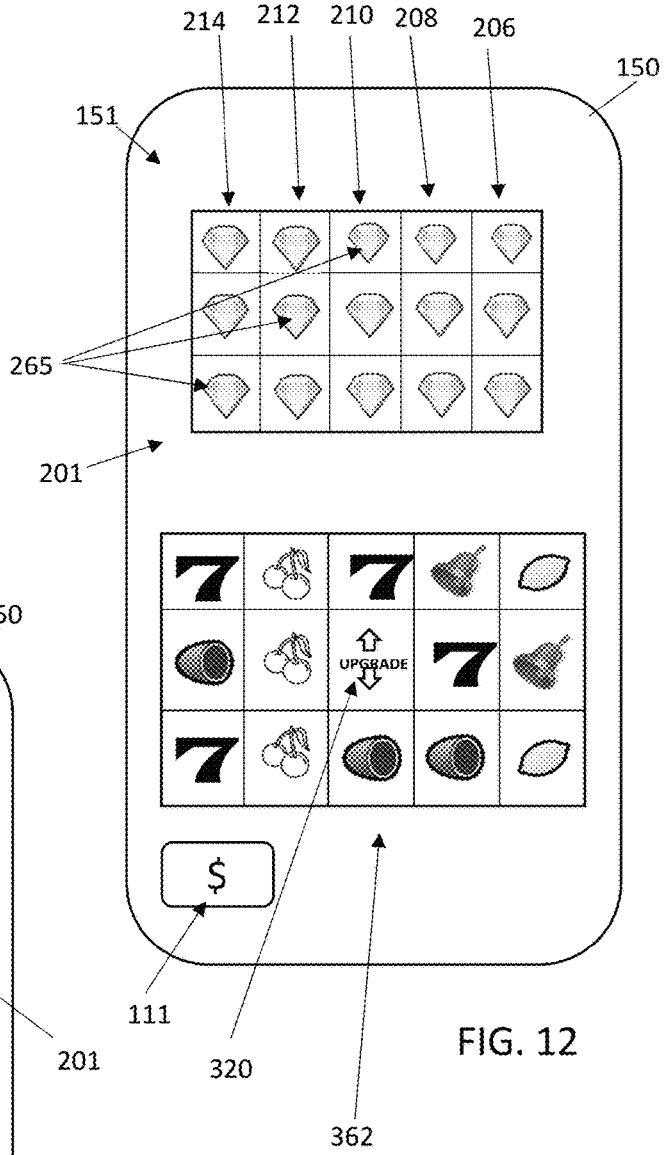
Figure 13:
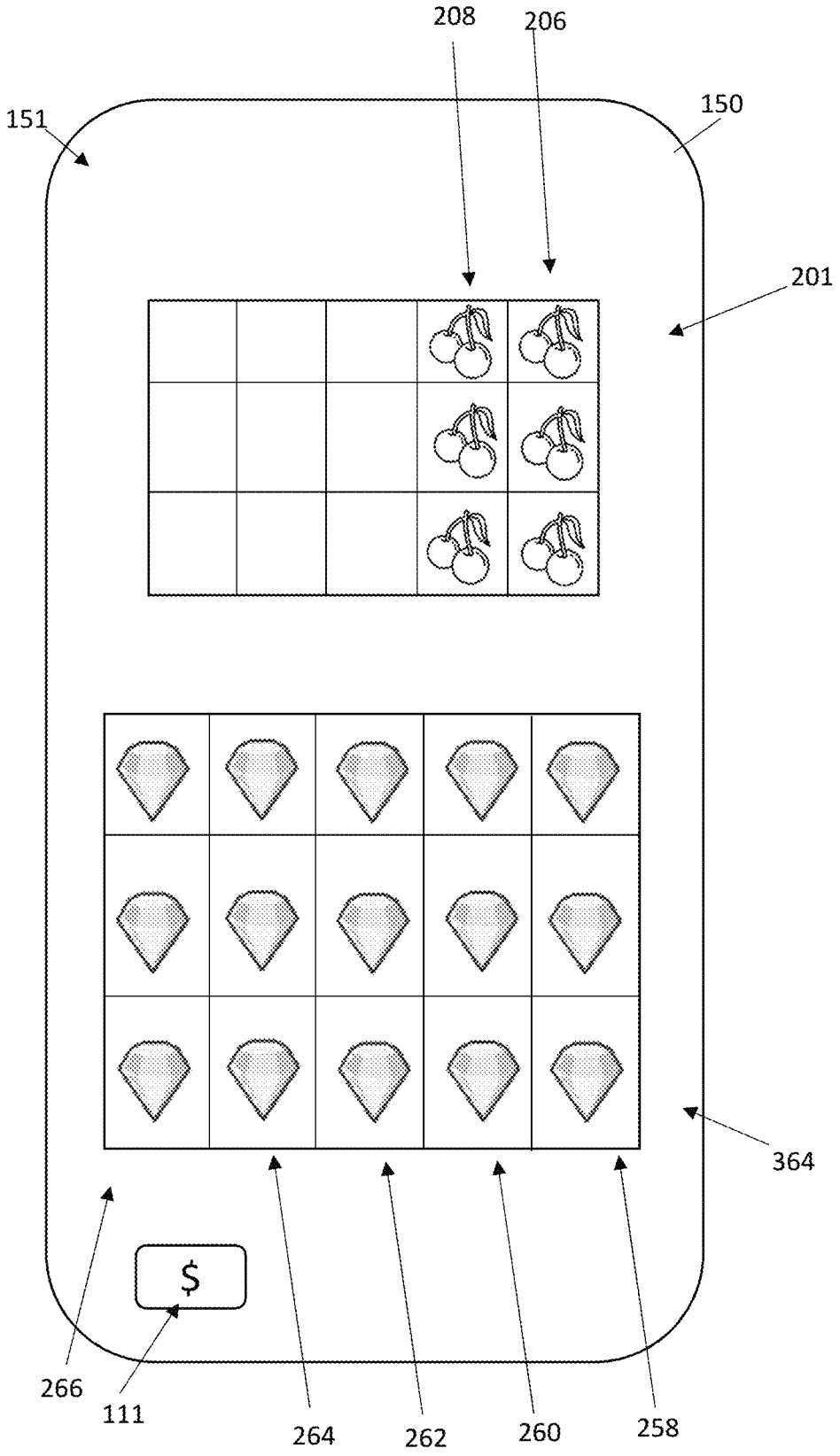

In other instances, the top matrix expression 201 can be filled with symbols (e.g., 265) of the highest value in all reels 206, 208, 210, 212 and 214, as shown in FIGS. 11 and 12. In such instance, if the modifier event is a top matrix symbol grow modifier 310 (FIG. 11) or a top matrix symbol upgrade modifier 320 (FIG. 12), the gaming system can treat such modifier events as a top matrix symbol drop modifier, thereby replacing the display of the first base matrix outcome 362 with a display of a second base matrix outcome 364 (FIG. 13) that includes the top matrix expression 201. As shown in FIG. 13, the second base matrix outcome 364 shows the diamond symbols 265 of the top matrix expression 201 of FIGS. 11 and 12 in each of the base matrix reels 258, 260, 262, 264 and 266. In various embodiments, as further shown in FIG. 13, the display of the top matrix expression 201 can also be changed back to an initial setting after such action, where, for example, reels 206, 208 of the top matrix expression 201 are initialized as cherry symbols.

It should be appreciated that: (a) the quantity of rows in the top matrix; (b) the quantity of reels in the top matrix; (c) the quantity of rows in the base matrix; (d) the quantity of reels in the base matrix; (e) the arrangement of symbols within the top matrix and base matrix; (f) the payouts associated with the symbols and/or paylines; (g) the occurrence of one or more modifier events; and/or (h) any other variables and determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM; (9) determined independently of a random determination at the EGM; (10) determined based on at least one play of at least one game; (11) determined independently of at least one play of at least one game; (12) determined based on a player's selection; (13) determined independently of a player's selection; (14) determined based on one or more side wagers placed; (15) determined independently of one or more side wagers placed; (16) determined based on the player's primary game wager or wager level; (17) determined independently of the player's primary game wager or wager level; (18) determined based on time (such as the time of day); (19) determined independently of time (such as the time of day); (20) determined based on an amount of coin-in accumulated in one or more pools; (21) determined independently of an amount of coin-in accumulated in one or more pools; (22) determined based on a status of the player (i.e., a player tracking status); (23) determined independently of a status of the player (i.e., a player tracking status); (24) determined based on one or more other determinations disclosed herein; (25) determined independently of any other determination disclosed herein; and/or (26) determined in any other suitable manner or based on or independent of any other suitable factor(s). Any such determination can be considered a generation of such variable value by the gaming system as disclosed herein.

The above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices.

Thus, in various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, the term "EGM" is used herein to refer to an electronic gaming machine (such as a slot machine, a video poker machine, a video lottery terminal (VLT), a video keno machine, or a video bingo machine located on a casino floor). Additionally, for brevity and clarity and unless specifically stated otherwise, "EGM" as used herein represents one EGM or a plurality of EGMs, "personal gaming device" as used herein represents one personal gaming device or a plurality of personal gaming devices, and "central server, central controller, or remote host" as used herein represents one central server, central controller, or remote host or a plurality of central servers, central controllers, or remote hosts.

Figure 15:
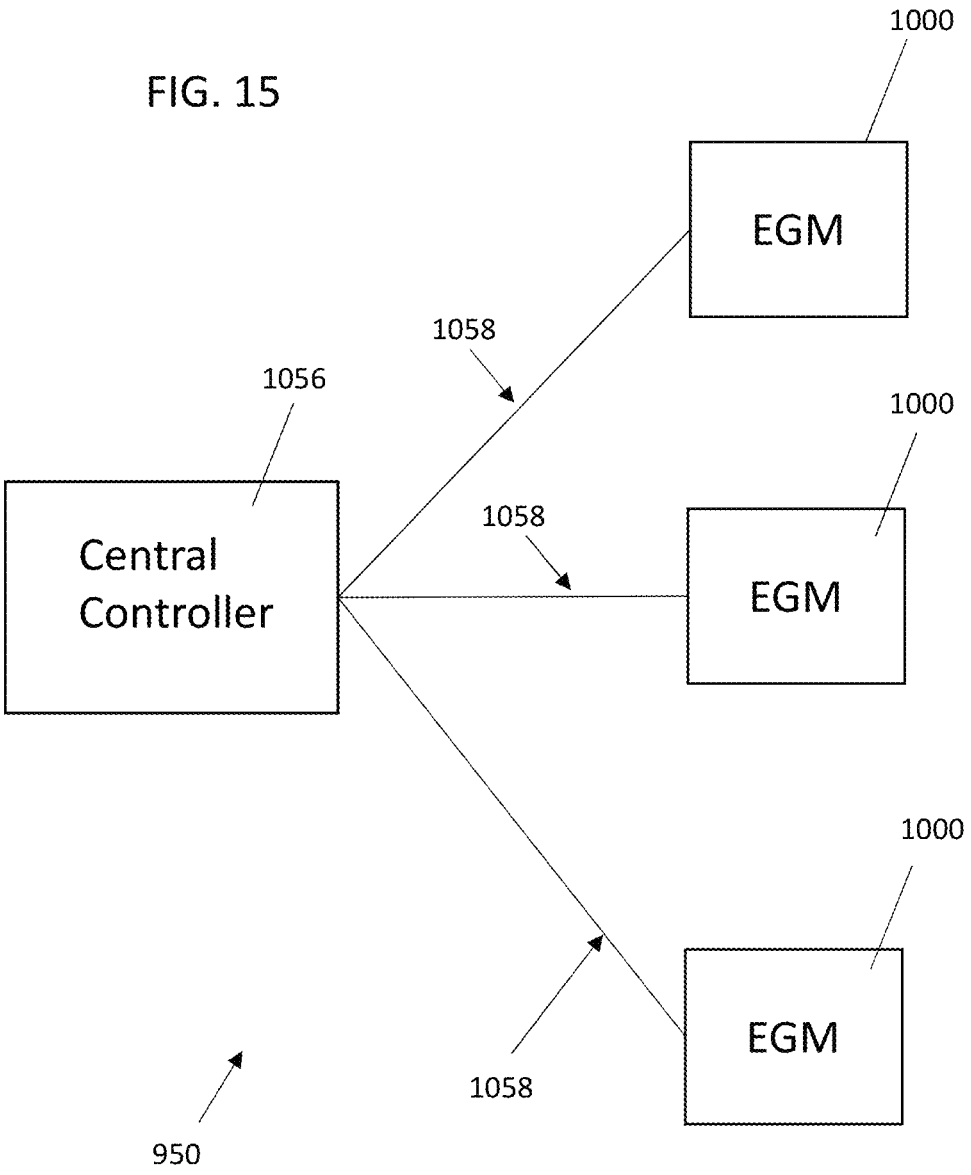
FIG. 15 is a schematic block diagram of one embodiment of a network configuration of the gaming system disclosed herein.

As noted above, in various embodiments, the gaming system includes an EGM (or personal gaming device) in combination with a central server, central controller, or remote host. In such embodiments, the EGM (or personal gaming device) is configured to communicate with the central server, central controller, or remote host through a data network or remote communication link. In certain such embodiments, the EGM (or personal gaming device) is configured to communicate with another EGM (or personal gaming device) through the same data network or remote communication link or through a different data network or remote communication link. For example, the gaming system 950 illustrated in FIG. 15 includes a plurality of EGMs 1000 that are each configured to communicate with a central server, central controller, or remote host 1056 through a data network 1058.

In certain embodiments in which the gaming system includes an EGM (or personal gaming device) in combination with a central server, central controller, or remote host, the central server, central controller, or remote host is any suitable computing device (such as a server) that includes at least one processor and at least one memory device or data storage device. As further described herein, the EGM (or personal gaming device) includes at least one EGM (or personal gaming device) processor configured to transmit and receive data or signals representing events, messages, commands, or any other suitable information between the EGM (or personal gaming device) and the central server, central controller, or remote host. The at least one processor of that EGM (or personal gaming device) is configured to execute the events, messages, or commands represented by such data or signals in conjunction with the operation of the EGM (or personal gaming device). Moreover, the at least one processor of the central server, central controller, or remote host is configured to transmit and receive data or signals representing events, messages, commands, or any other suitable information between the central server, central controller, or remote host and the EGM (or personal gaming device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal gaming device). Further, one, more than one, or each of the functions of the at least one processor of the EGM (or personal gaming device) may be performed by the at least one processor of the central server, central controller, or remote host.

In certain such embodiments, computerized instructions for controlling any games (such as any primary or base games and/or any secondary or bonus games) displayed by the EGM (or personal gaming device) are executed by the central server, central controller, or remote host. In such "thin client" embodiments, the central server, central controller, or remote host remotely controls any games (or other suitable interfaces) displayed by the EGM (or personal gaming device), and the EGM (or personal gaming device) is utilized to display such games (or suitable interfaces) and to receive one or more inputs or commands. In other such embodiments, computerized instructions for controlling any games displayed by the EGM (or personal gaming device) are communicated from the central server, central controller, or remote host to the EGM (or personal gaming device) and are stored in at least one memory device of the EGM (or personal gaming device). In such "thick client" embodiments, the at least one processor of the EGM (or personal gaming device) executes the computerized instructions to control any games (or other suitable interfaces) displayed by the EGM (or personal gaming device).

In various embodiments in which the gaming system includes a plurality of EGMs (or personal gaming devices), one or more of the EGMs (or personal gaming devices) are thin client EGMs (or personal gaming devices) and one or more of the EGMs (or personal gaming devices) are thick client EGMs (or personal gaming devices). In other embodiments in which the gaming system includes one or more EGMs (or personal gaming devices), certain functions of one or more of the EGMs (or personal gaming devices) are implemented in a thin client environment, and certain other functions of one or more of the EGMs (or personal gaming devices) are implemented in a thick client environment. In one such embodiment in which the gaming system includes an EGM (or personal gaming device) and a central server, central controller, or remote host, computerized instructions for controlling any primary or base games displayed by the EGM (or personal gaming device) are communicated from the central server, central controller, or remote host to the EGM (or personal gaming device) in a thick client configuration, and computerized instructions for controlling any secondary or bonus games or other functions displayed by the EGM (or personal gaming device) are executed by the central server, central controller, or remote host in a thin client configuration.

In certain embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is a local area network (LAN) in which the EGMs (or personal gaming devices) are located substantially proximate to one another and/or the central server, central controller, or remote host. In one example, the EGMs (or personal gaming devices) and the central server, central controller, or remote host are located in a gaming establishment or a portion of a gaming establishment.

In other embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is a wide area network (WAN) in which one or more of the EGMs (or personal gaming devices) are not necessarily located substantially proximate to another one of the EGMs (or personal gaming devices) and/or the central server, central controller, or remote host. For example, one or more of the EGMs (or personal gaming devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal gaming devices) are located. In certain embodiments in which the data network is a WAN, the gaming system includes a central server, central controller, or remote host and an EGM (or personal gaming device) each located in a different gaming establishment in a same geographic area, such as a same city or a same state. Gaming systems in which the data network is a WAN are substantially identical to gaming systems in which the data network is a LAN, though the quantity of EGMs (or personal gaming devices) in such gaming systems may vary relative to one another.

In further embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is an internet (such as the Internet) or an intranet. In certain such embodiments, an Internet browser of the EGM (or personal gaming device) is usable to access an Internet game page from any location where an Internet connection is available. In one such embodiment, after the EGM (or personal gaming device) accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique username and password combination assigned to the player. The central server, central controller, or remote host may, however, identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM (or personal gaming device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal gaming device).

The central server, central controller, or remote host and the EGM (or personal gaming device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal gaming devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 14:
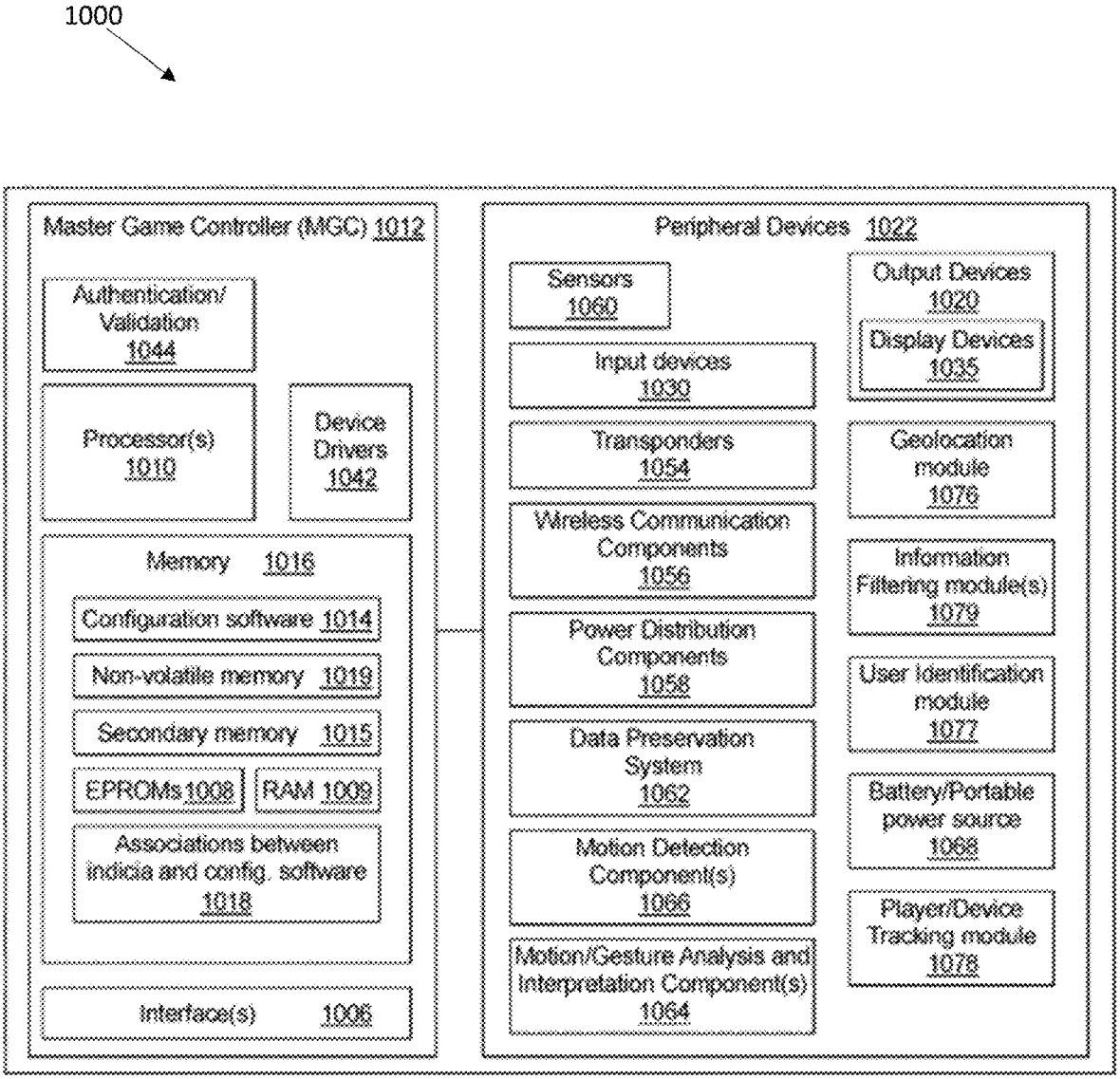
FIG. 14 is a schematic block diagram of an example electronic configuration of one embodiment of the gaming system of the present disclosure.
Figure 16:
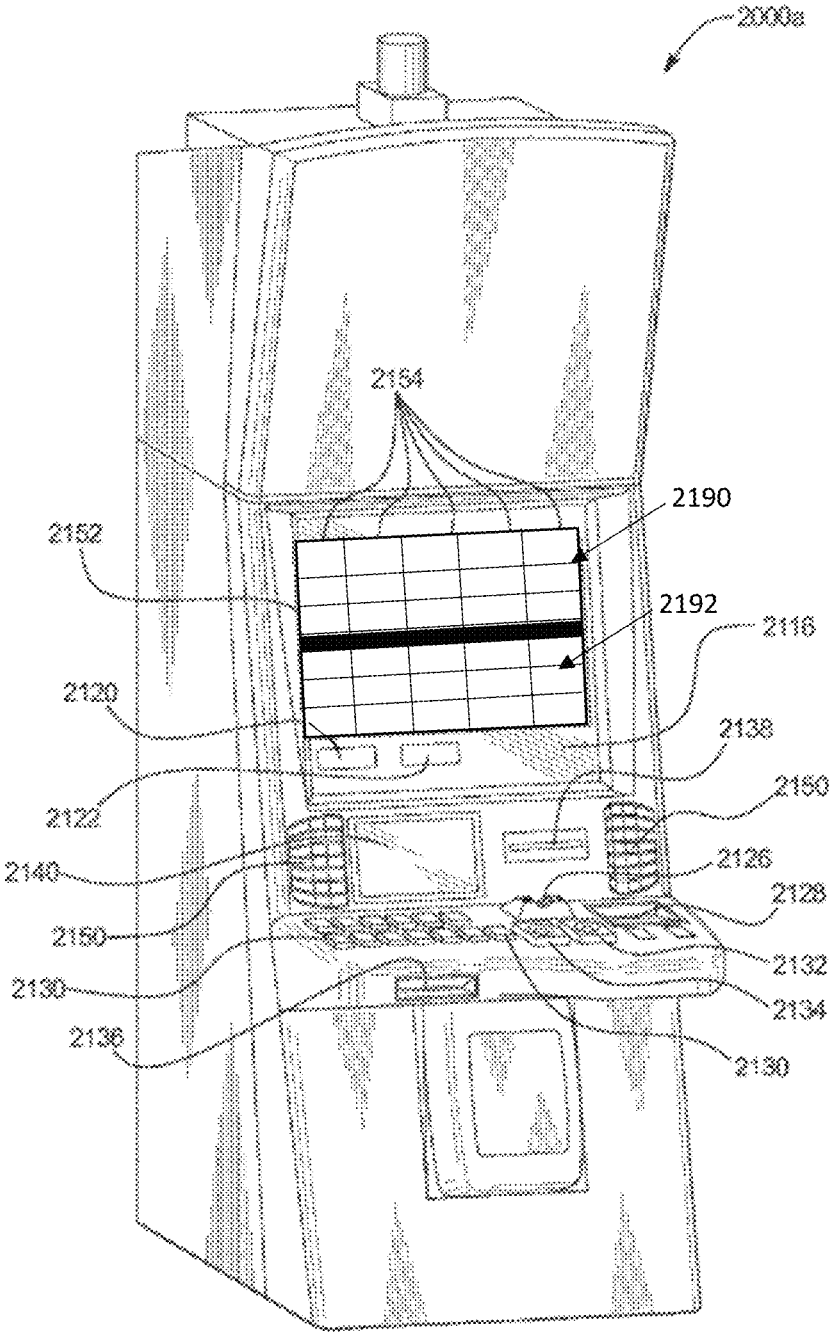
FIGS. 16 and 17 are perspective views of example alternative embodiments of the gaming system disclosed herein.
Figure 17:
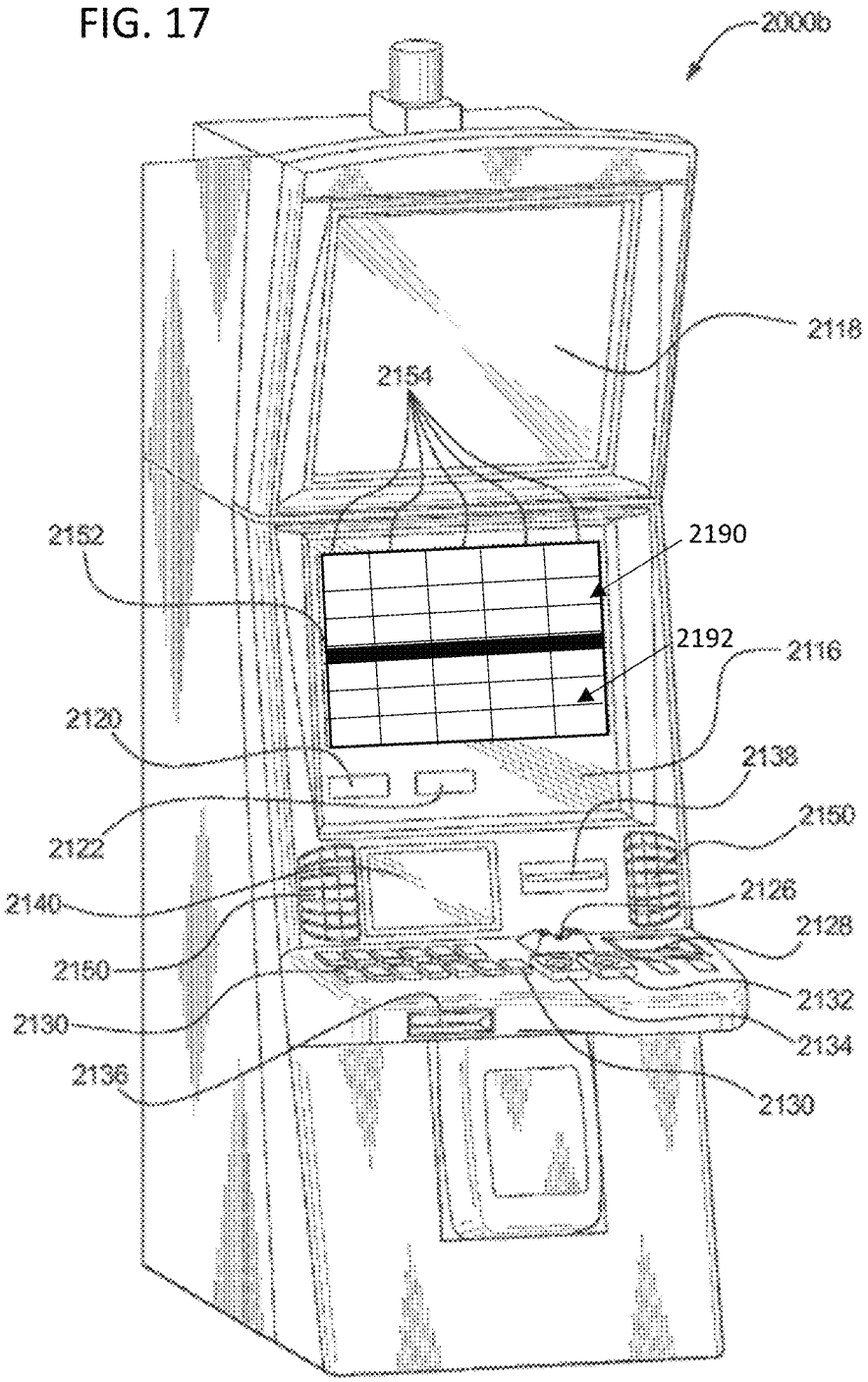

FIG. 14 is a block diagram of an example EGM 1000 and FIGS. 16 and 17 include two different example EGMs 2000*a* and 2000*b*. The EGMs 1000, 2000*a*, and 2000*b* are merely example EGMs, and different EGMs may be implemented using different combinations of the components shown in the EGMs 1000, 2000*a*, and 2000*b*. Although the below refers to EGMs, in various embodiments personal gaming devices (such as personal gaming device 150 of FIGS. 2 through 13) may include some or all of the below components.

In these embodiments, the EGM 1000 includes a master gaming controller 1012 configured to communicate with and to operate with a plurality of peripheral devices 1022.

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022. In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM. In these embodiments, any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 1012 communicates with other devices using a serial communication protocol. A few non-limiting examples of serial communication protocols that other devices, such as peripherals (e.g., a bill validator or a ticket printer), may use to communicate with the master game controller 1012 include USB and RS-232.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Computer program code for carrying out operations for aspects of the present disclosure may be written in any combination of one or more programming languages, including an object oriented programming language such as Java, Scala, Smalltalk, Eiffel, JADE, Emerald, C++, C #, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc.

In certain embodiments, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 1035 configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 2000*a* illustrated in FIG. 16 includes a central display device 2116, a player tracking display 2140, a credit display 2120, and a bet display 2122. The example EGM 2000*b* illustrated in FIG. 17 includes a central display device 2116, an upper display device 2118, a player tracking display 2140, a credit display 2120, and a bet display 2122. In various embodiments, the central display device 2116 in the example EGMs 2000*a* and 2000*b* can provide a game display 2152 with top matrix 2190 (with top matrix reels 2154) and base matrix 2192 shown therein.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGMs 2000*a* and 2000*b* illustrated in FIGS. 16 and 17 each include a ticket printer and dispenser 2136.

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player.

While any credit balances, any wagers, any values, and any awards are described herein and can be displayed as amounts of monetary credits or currency, one or more of such credit balances, such wagers, such values, and such awards may be for non-monetary credits, promotional credits, of player tracking points or credits.

In certain embodiments, the at least one output device 1020 is a sound generating device controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGMs 2000*a* and 2000*b* illustrated in FIGS. 16 and 17 each include a plurality of speakers 2150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGMs 2000*a* and 2000*b* illustrated in FIGS. 16 and 17 each include a combined bill and ticket acceptor 2128 and a coin slot 2126. In various embodiments, responsive to a physical item being received via one of the acceptors, the gaming system described herein establishes a credit balance based upon a monetary value associated with the received physical item, and responsive to a cashout input being received, causes an initiation of any payout associated with the credit balance. In various embodiments, responsive to any determined award based upon a base matrix outcome, the player's credit balance is increased by the amount of the award.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGMs 2000*a* and 2000*b* illustrated in FIGS. 16 and 17 each include a game play activation device in the form of a game play initiation button 2132. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGMs 2000*a* and 2000*b* illustrated in FIGS. 16 and 17 each include a cashout device in the form of a cashout button 2134.

In various embodiments, the at least one input device 1030 includes a plurality of buttons that are programmable by the EGM operator to, when actuated, cause the EGM to perform particular functions. For instance, such buttons may be hard keys, programmable soft keys, or icons icon displayed on a display device of the EGM (described below) that are actuatable via a touch screen of the EGM (described below) or via use of a suitable input device of the EGM (such as a mouse or a joystick). The example EGMs 2000*a* and 2000*b* illustrated in FIGS. 16 and 17 each include a plurality of such buttons 2130.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The example EGMs 2000*a* and 2000*b* illustrated in FIGS. 16 and 17 each include a card reader 2138. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM; detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

The at least one motion/gesture analysis and interpretation component 1064 is configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGM to operate in a mobile environment. For example, in one embodiment, the EGM 300 includes one or more rechargeable batteries.

The at least one geolocation module 1076 is configured to acquire geolocation information from one or more remote sources and use the acquired geolocation information to determine information relating to a relative and/or absolute position of the EGM. For example, in one implementation, the at least one geolocation module 1076 is configured to receive GPS signal information for use in determining the position or location of the EGM. In another implementation, the at least one geolocation module 1076 is configured to receive multiple wireless signals from multiple remote devices (e.g., EGMs, servers, wireless access points, etc.) and use the signal information to compute position/location information relating to the position or location of the EGM.

The at least one user identification module 1077 is configured to determine the identity of the current user or current owner of the EGM. For example, in one embodiment, the current user performs a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays 1035 of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices.

As generally described above, in certain embodiments, such as the example EGMs 2000*a* and 2000*b* illustrated in FIGS. 16 and 17, the EGM has a support structure, housing, or cabinet that provides support for a plurality of the input devices and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 2000*a* and 2000*b* shown in FIGS. 16 and 17, EGMs may have varying housing and display configurations.

In certain embodiments, the EGM is a device that has obtained approval from a regulatory gaming commission, and in other embodiments, the EGM is a device that has not obtained approval from a regulatory gaming commission.

The EGMs described above are merely three examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

Web-Based Gaming

In various embodiments, the gaming system includes one or more servers configured to communicate with a personal gaming device—such as a smartphone, a tablet computer, a desktop computer, a laptop computer or other mobile computing device—to enable web-based game play using the personal gaming device. In various embodiments, the player must first access a gaming website via an Internet browser of the personal gaming device or execute an application (commonly called an "app") installed on the personal gaming device before the player can use the personal gaming device to participate in web-based game play. In certain embodiments, the one or more servers and the personal gaming device operate in a thin-client environment. In these embodiments, the personal gaming device receives inputs via one or more input devices (such as a touch screen and/or physical buttons), the personal gaming device sends the received inputs to the one or more servers, the one or more servers make various determinations based on the inputs and determine content to be displayed (such as a randomly determined game outcome and corresponding award), the one or more servers send the content to the personal gaming device, and the personal gaming device displays the content on a display device of the personal gaming device. In various embodiments, the input device and the display device are housed in the personal gaming device.

In certain such embodiments, the one or more servers must identify the player before enabling game play on the personal gaming device (or, in some embodiments, before enabling monetary wager-based game play on the personal gaming device). In these embodiments, the player must identify herself to the one or more servers, such as by inputting the player's unique username and password combination, providing an input to a biometric sensor (e.g., a fingerprint sensor, a retinal sensor, a voice sensor, or a facial-recognition sensor), or providing any other suitable information.

Once identified, the one or more servers enable the player to establish an account balance from which the player can draw credits usable to wager on plays of a game. In certain embodiments, the one or more servers enable the player to initiate an electronic funds transfer to transfer funds from a bank account to the player's account balance. In other embodiments, the one or more servers enable the player to make a payment using the player's credit card, debit card, or other suitable device to add money to the player's account balance. In other embodiments, the one or more servers enable the player to add money to the player's account balance via a peer-to-peer type application, such as PayPal™ or Venmo™. The one or more servers also enable the player to cash out the player's account balance (or part of it) in any suitable manner, such as via an electronic funds transfer, by initiating creation of a paper check that is mailed to the player, or by initiating printing of a voucher at a kiosk in a gaming establishment.

In certain embodiments, the one or more servers include a payment server that handles establishing and cashing out players' account balances and a separate game server configured to determine the outcome and any associated award for a play of a game. In these embodiments, the game server is configured to communicate with the personal gaming device and the payment device, and the personal gaming device and the payment device are not configured to directly communicate with one another. In these embodiments, when the game server receives data representing a request to start a play of a game at a desired wager, the game server sends data representing the desired wager to the payment server. The payment server determines whether the player's account balance can cover the desired wager (i.e., includes a monetary balance at least equal to the desired wager).

If the payment server determines that the player's account balance cannot cover the desired wager, the payment server notifies the game server, which then instructs the personal gaming device to display a suitable notification to the player that the player's account balance is too low to place the desired wager. If the payment server determines that the player's account balance can cover the desired wager, the payment server deducts the desired wager from the account balance and notifies the game server. The game server then determines an outcome and any associated award for the play of the game. The game server notifies the payment server of any nonzero award, and the payment server increases the player's account balance by the nonzero award. The game server sends data representing the outcome and any award to the personal gaming device, which displays the outcome and any award.

In certain embodiments, the one or more servers enable web-based game play using a personal gaming device only if the personal gaming device satisfies one or more jurisdictional requirements. In one embodiment, the one or more servers enable web-based game play using the personal gaming device only if the personal gaming device is located within a designated geographic area (such as within certain state or county lines or within the boundaries of a gaming establishment). In this embodiment, the geolocation module of the personal gaming device determines the location of the personal gaming device and sends the location to the one or more servers, which determine whether the personal gaming device is located within the designated geographic area. In various embodiments, the one or more servers enable non-monetary wager-based game play if the personal gaming device is located outside of the designated geographic area.

In various embodiments, the gaming system includes an EGM configured to communicate with a personal gaming device—such as a smartphone, a tablet computer, a desktop computer, or a laptop computer—to enable tethered mobile game play using the personal gaming device. Generally, in these embodiments, the EGM establishes communication with the personal gaming device and enables the player to play games on the EGM remotely via the personal gaming device. In certain embodiments, the gaming system includes a geo-fence system that enables tethered game play within a particular geographic area but not outside of that geographic area.

Social Network Integration

In certain embodiments, the gaming system is configured to communicate with a social network server that hosts or partially hosts a social networking website via a data network (such as the Internet) to integrate a player's gaming experience with the player's social networking account. This enables the gaming system to send certain information to the social network server that the social network server can use to create content (such as text, an image, and/or a video) and post it to the player's wall, newsfeed, or similar area of the social networking website accessible by the player's connections (and in certain cases the public) such that the player's connections can view that information. This also enables the gaming system to receive certain information from the social network server, such as the player's likes or dislikes or the player's list of connections. In certain embodiments, the gaming system enables the player to link the player's player account to the player's social networking account(s). This enables the gaming system to, once it identifies the player and initiates a gaming session (such as via the player logging in to a website (or an application) on the player's personal gaming device or via the player inserting the player's player tracking card into an EGM), link that gaming session to the player's social networking account(s). In other embodiments, the gaming system enables the player to link the player's social networking account(s) to individual gaming sessions when desired by providing login information, for example.

For instance, in one embodiment, if a player wins a particular award (e.g., a progressive award or a jackpot award) or an award that exceeds a certain threshold (e.g., an award exceeding $1,000), the gaming system sends information about the award to the social network server to enable the server to create associated content (such as a screenshot of the outcome and associated award) and to post that content to the player's wall (or other suitable area) of the social networking website for the player's connections to see (and to entice them to play). In another embodiment, if a player joins a multiplayer game and there is another seat available, the gaming system sends that information to the social network sever to enable the server to create associated content (such as text indicating a vacancy for that particular game) and to post that content to the player's wall (or other suitable area) of the social networking website for the player's connections to see (and to entice them to fill the vacancy). In another embodiment, if the player consents, the gaming system sends advertisement information or offer information to the social network server to enable the social network server to create associated content (such as text or an image reflecting an advertisement and/or an offer) and to post that content to the player's wall (or other suitable area) of the social networking website for the player's connections to see. In another embodiment, the gaming system enables the player to recommend a game to the player's connections by posting a recommendation to the player's wall (or other suitable area) of the social networking website.

What is claimed is:

1. A gaming system; comprising:

an input device;

a processor; and a memory device which stores a plurality of instructions, which when executed by the processor, cause the processor to:

receive, via the input device, a placement of a wager amount on a play of a game;

cause a display device to display a persistent top matrix expression comprising at least a first top matrix symbol displayed at at least a first top matrix symbol display position associated with at least a first top matrix reel of a plurality of top matrix reels of a top matrix;

cause the display device to display a first base matrix outcome comprising a plurality of base matrix symbols displayed at a plurality of base matrix symbol display positions associated with a plurality of base matrix reels of a base matrix;

responsive to an occurrence of a modifier event, cause the display device to alter the display of the persistent top matrix expression, wherein a first modifier event is associated with a first alteration and a second, different modifier event is associated with a second, different alteration;

determine any award associated with the displayed first base matrix outcome; and cause the display device to display any determined award associated with the displayed first base matrix outcome.

2. The gaming system of claim 1, wherein the occurrence of the modifier event comprises a designated base matrix symbol being displayed at a first one of the symbol display positions associated with a first one of the plurality of base matrix reels.

3. The gaming system of claim 1, wherein when executed by the processor responsive to the modifier event comprising a top matrix symbol grow modifier, the plurality of instructions cause the processor to cause the display device to alter the display of the persistent top matrix expression by displaying the first top matrix symbol at a second top matrix symbol display position associated with a second top matrix reel of the plurality of top matrix reels.

4. The gaming system of claim 1, wherein when executed by the processor responsive to the modifier event comprising a top matrix symbol upgrade modifier, the plurality of instructions cause the processor to cause the display device to alter the display of the persistent top matrix expression by replacing the first top matrix symbol with an upgraded top matrix symbol associated with a higher value than a value associated with the first top matrix symbol.

5. The gaming system of claim 1, wherein when executed by the processor responsive to the modifier event comprising a top matrix symbol drop modifier, the plurality of instructions cause the processor to:

cause the display device to replace the display of the first base matrix outcome with a display of a second base matrix outcome comprising the persistent top matrix expression, determine any award associated with the second base matrix outcome, and cause the display device to display any determined award associated with the second base matrix outcome.

6. The gaming system of claim 1, wherein when executed by the processor responsive to the modifier event comprising a top matrix symbol grow modifier and a top matrix symbol upgrade modifier, the plurality of instructions cause the processor to:

cause the display device to alter the display of the persistent top matrix expression by displaying the top matrix symbol at a second top matrix symbol display position associated with a second top matrix reel of the plurality of top matrix reels, and cause the display device to additionally alter the display of the persistent top matrix expression by replacing the first top matrix symbol with an upgraded top matrix symbol associated with a higher value than a value associated with the first top matrix symbol.

7. The gaming system of claim 1, wherein when executed by the processor responsive to the modifier event comprising a top matrix symbol upgrade modifier and a top matrix symbol drop modifier, the plurality of instructions cause the processor to:

cause the display device to alter the display of the persistent top matrix expression by replacing the first top matrix symbol with an upgraded top matrix symbol comprising an upgraded top matrix symbol associated with a higher value than a value associated with the first top matrix symbol, and cause the display device to replace the display of the first base matrix outcome with a display of a second base matrix outcome comprising the persistent top matrix expression.

8. The gaming system of claim 1, wherein when executed by the processor responsive to the modifier event comprising a top matrix symbol grow modifier and a top matrix symbol drop modifier, the plurality of instructions cause the processor to:

cause the display device to alter the display of the persistent top matrix expression by displaying the first top matrix symbol at a second top matrix symbol display position associated with a second top matrix reel of the plurality of top matrix reels, and cause the display device to replace the display of the first base matrix outcome with a display of a second base matrix outcome comprising the persistent top matrix expression.

9. The gaming system of claim 1, wherein when executed by the processor responsive to the modifier event comprising a top matrix symbol grow modifier, a top matrix symbol upgrade modifier and a top matrix symbol drop modifier, the plurality of instructions cause the processor to:

cause the display device to alter the display of the persistent top matrix expression by displaying the first top matrix symbol at a second top matrix symbol display position associated with a second top matrix reel of the plurality of top matrix reels, cause the display device to additionally alter the display of the persistent top matrix expression by replacing the first top matrix symbol with an upgraded top matrix symbol comprising an upgraded symbol associated with a higher value than a value associated with the first top matrix symbol, and cause the display device to replace the display of the first base matrix outcome with a display of a second base matrix outcome comprising the persistent top matrix expression.

10. The gaming system of claim 1, wherein when executed by the processor responsive to the modifier event comprising a top matrix symbol grow modifier and the persistent top matrix expression comprising the first top matrix symbol displayed at each of a plurality of symbol display positions associated with each of the plurality of top matrix reels, the plurality of instructions cause the processor to cause the display device to alter the display of the persistent top matrix expression by replacing the first top matrix symbol with an upgraded top matrix symbol associated with a higher value than a value associated with the first top matrix symbol.

11. The gaming system of claim 1, wherein when executed by the processor responsive to the modifier event comprising a top matrix symbol upgrade modifier and the persistent top matrix expression comprising a second top matrix symbol associated with a maximum value, the plurality of instructions cause the processor to cause the display device to alter the display of the persistent top matrix expression by displaying the second top matrix symbol at a second top matrix symbol display position associated with a second top matrix reel of the plurality of top matrix reels.

12. The gaming system of claim 1, wherein when executed by the processor responsive to the modifier event comprising a top matrix symbol grow modifier, and the persistent top matrix expression comprising a second top matrix symbol associated with a maximum value displayed at each of a plurality of top matrix symbol display positions associated with the plurality of top matrix reels, the plurality of instructions cause the processor to cause the display device to replace the display of the first base matrix outcome with a display of a second base matrix outcome comprising the persistent top matrix expression.

13. The gaming system of claim 1, wherein the input device is housed in a mobile computing device.

14. The gaming system of claim 1, further comprising an acceptor of a first physical item associated with a first monetary value, wherein when executed by the processor responsive to receipt of the first physical item, the plurality of instructions cause the processor to modify a credit balance based on the first monetary value.

15. A gaming system; comprising:

an input device;

a processor; and a memory device which stores a plurality of instructions, which when executed by the processor, cause the processor to:

receive, via the input device, a placement of a wager amount on a play of a game;

cause a display device to display a top matrix expression comprising at least a first top matrix symbol displayed at at least a first top matrix symbol display position associated with at least a first top matrix reel of a plurality of top matrix reels of a top matrix;

cause the display device to display a first base matrix outcome comprising a plurality of base matrix symbols displayed at a plurality of base matrix symbol display positions associated with a plurality of base matrix reels of a base matrix;

determine any award associated with the displayed first base matrix outcome;

cause the display device to display any determined award associated with the displayed first base matrix outcome; and responsive to an occurrence of a modifier event:

cause the display device to replace the first base matrix outcome with a display of a second base matrix outcome comprising the top matrix expression;

determine any award associated with the displayed second base matrix outcome; and cause the display device to display any determined award associated with the displayed second base matrix outcome.

16. The gaming system of claim 15, wherein the modifier event comprises a top matrix symbol drop modifier.

17. The gaming system of claim 15, wherein the modifier event comprises a top matrix symbol grow modifier, and the top matrix expression comprises a second top matrix symbol associated with a maximum value displayed at each of a plurality of top matrix symbol display positions associated with each of the plurality of top matrix reels.

18. The gaming system of claim 15, wherein the modifier event comprises a top matrix symbol upgrade modifier, and the top matrix expression comprises a second top matrix symbol associated with a maximum value displayed at each of a plurality of top matrix symbol display positions associated with each of the plurality of top matrix reels.

19. A method of operating a gaming system, the method comprising:

displaying, by a display device, a first base matrix outcome comprising a plurality of base matrix symbols displayed at a plurality of base matrix symbol display positions associated with a plurality of base matrix reels of a base matrix;

displaying, by the display device, a top matrix expression comprising at least a first top matrix symbol displayed at at least a first top matrix symbol display position associated with a first top matrix reel of a plurality of top matrix reels of a top matrix;

responsive to a first base matrix symbol displayed at a first symbol display position associated with a first one of the plurality of base matrix reels comprising a top matrix symbol grow modifier, displaying, by the display device, a first alteration of the display of the top matrix expression comprising displaying, by the display device, the first top matrix symbol at a second top matrix symbol display position associated with a second top matrix reel of the plurality of top matrix reels;

responsive to the first base matrix symbol displayed at the first symbol display position associated with the first one of the plurality of base matrix reels comprising a top matrix symbol upgrade modifier, displaying, by the display device, a second alteration of the display of the top matrix expression comprising a replacement of the first top matrix symbol with an upgraded top matrix symbol associated with a higher value than a value associated with the first top matrix symbol;

responsive to the first base matrix symbol displayed at the first symbol display position associated with the first one of the plurality of base matrix reels comprising a top matrix symbol drop modifier, displaying, by the display device, a replacement of the display of the first base matrix outcome with a display of a second base matrix outcome comprising the top matrix expression;

determining, by a processor, any award associated with the displayed first base matrix outcome; and displaying, by the display device, any determined award associated with the displayed first base matrix outcome.

20. The method of claim 19, further comprising, responsive to the first base matrix symbol displayed at the first symbol display position associated with the first one of the plurality of base matrix reels comprising the top matrix symbol drop modifier:

determining, by the processor, any award associated with the second base matrix outcome; and displaying, by the display device, any determined award associated with the second base matrix outcome.

* * * * *